US011572845B1

(12) United States Patent
Dieudonne et al.

(10) Patent No.: US 11,572,845 B1
(45) Date of Patent: Feb. 7, 2023

(54) METHODS AND SYSTEMS FOR CYLINDER DIAGNOSIS

(71) Applicant: Transportation IP Holdings, LLC, Norwalk, CT (US)

(72) Inventors: Margaret Ilorieuse Dieudonne, Erie, PA (US); Jacob Kenneth Pedder, State College, PA (US); James Robert Mischler, Lawrence Park, PA (US); Luke Michael Henry, Lawrence Park, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 17/450,057

(22) Filed: Oct. 5, 2021

(51) Int. Cl.

| | |
|---|---|
| ***F02D 41/22*** | (2006.01) |
| ***F02D 41/38*** | (2006.01) |
| ***F02D 41/00*** | (2006.01) |
| ***B61C 5/00*** | (2006.01) |

(52) U.S. Cl.
CPC ..... *F02D 41/22* (2013.01); *B61C 5/00* (2013.01); *F02D 41/0097* (2013.01); *F02D 41/38* (2013.01); *F02D 2041/227* (2013.01); *F02D 2200/0614* (2013.01); *F02D 2200/101* (2013.01)

(58) Field of Classification Search
CPC ..... F02D 41/22; F02D 41/0097; F02D 41/38; F02D 41/008; F02D 41/1498; F02D 41/009; F02D 2041/227; F02D 2041/224; F02D 2200/0614; F02D 2200/101; B61C 5/00
See application file for complete search history.

(56) References Cited

U.S. PATENT DOCUMENTS

| | | | | |
|---|---|---|---|---|
| 9,951,703 | B2 * | 4/2018 | Pathan | B61C 17/00 |
| 10,837,376 | B2 | 11/2020 | Pathan et al. | |
| 2010/0175657 | A1 * | 7/2010 | Pursifull | F02N 19/00 701/113 |
| 2012/0283936 | A1 * | 11/2012 | Hashemi | F02D 41/008 701/113 |
| 2016/0169141 | A1 * | 6/2016 | Flynn | F02D 19/0623 701/102 |
| 2016/0333807 | A1 * | 11/2016 | Pathan | G01M 15/11 |
| 2017/0314498 | A1 * | 11/2017 | Pathan | F02D 41/3035 |

* cited by examiner

*Primary Examiner* — George C Jin
(74) *Attorney, Agent, or Firm* — McCoy Russell LLP

(57) ABSTRACT

Systems and methods are provided for diagnosing cylinders. In one example, a system includes an engine having a plurality of cylinders coupled to a crankshaft, a crankshaft speed sensor, and a controller. The controller is configured to receive a first output from the crankshaft speed sensor during nominal engine operation, receive a second output from the crankshaft speed sensor during engine operation where a fueling disturbance is introduced to a cylinder of the plurality of cylinders, indicate that the cylinder is unhealthy responsive to a difference between the first output and the second output being less than a threshold difference, and adjust one or more operating parameters of the engine in response to the indication.

13 Claims, 14 Drawing Sheets

METHODS AND SYSTEMS FOR CYLINDER DIAGNOSIS

BACKGROUND

Technical Field

Embodiments of the subject matter disclosed herein relate to systems and methods for diagnosing cylinders of an engine.

Discussion of Art

Cylinder health monitors may be used to detect cylinder misfire or other issues caused by fueling errors or other types of cylinder degradation. Typically, such cylinder health monitors assume that only one cylinder of the engine is unhealthy at a given time. As such, the cylinder health monitors may not robustly detect multiple unhealthy cylinders.

BRIEF DESCRIPTION

In one embodiment, a system includes an engine having a plurality of cylinders coupled to a crankshaft, a crankshaft speed sensor, and a controller. The controller is configured to receive a first output from the crankshaft speed sensor during nominal engine operation, receive a second output from the crankshaft speed sensor during engine operation where a fueling disturbance is introduced to a cylinder of the plurality of cylinders, indicate that the cylinder is unhealthy responsive to a difference between the first output and the second output being less than a threshold difference, and adjust one or more operating parameters of the engine in response to the indication.

DETAILED DESCRIPTION

Figure 1:
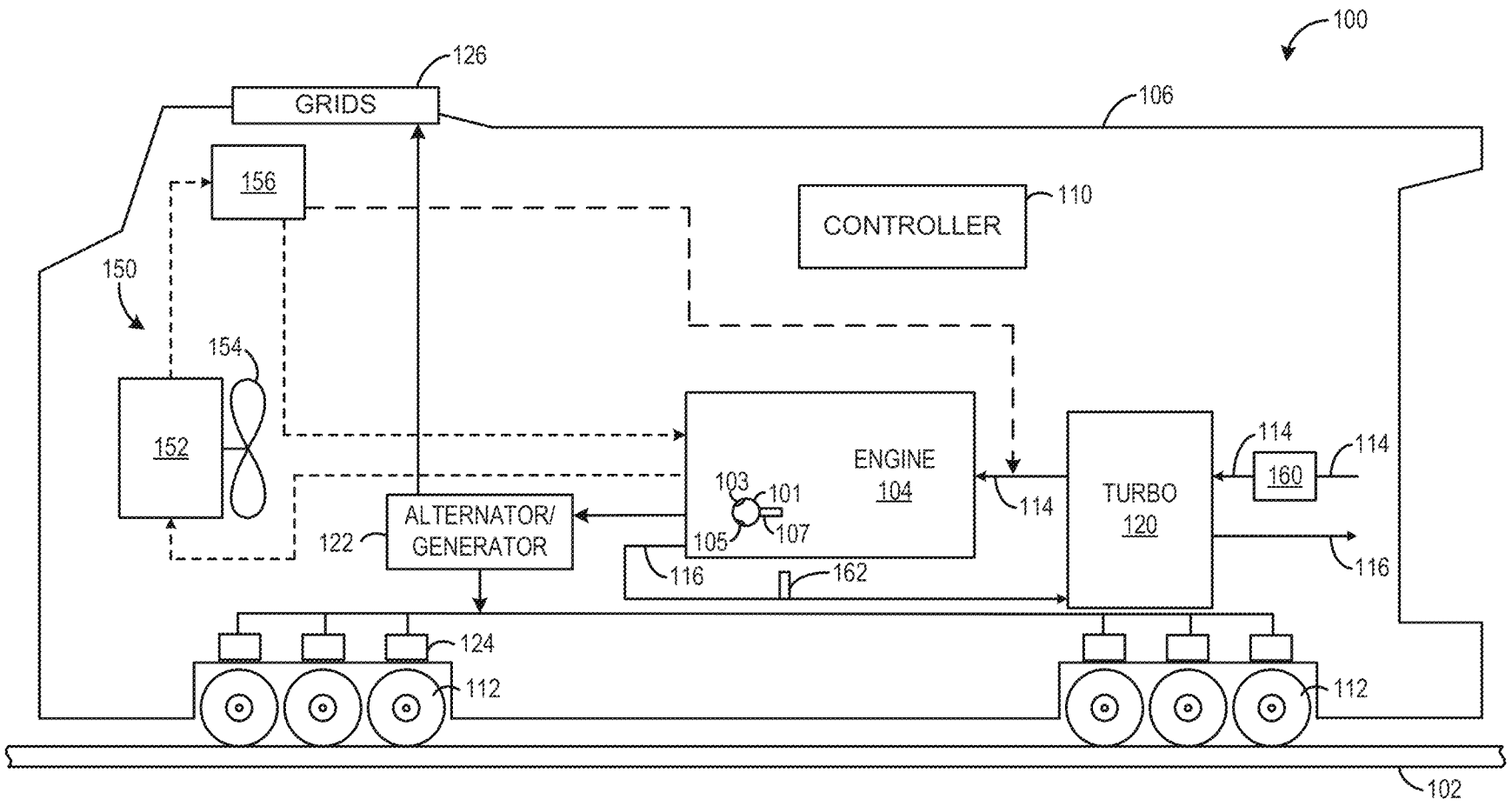
FIG. 1 shows a schematic diagram of a vehicle according to an embodiment of the present disclosure.

Embodiments of the invention are disclosed in the following description, and may relate to systems and methods for diagnosing cylinders based on output of a crankshaft speed sensor. For example, a controller may be configured to receive a first output from a crankshaft speed sensor coupled to an engine having a plurality of cylinders during nominal engine operation, where each cylinder of the engine receives the same amount fuel. The controller may receive a second output from the crankshaft speed sensor during engine operation where a fueling disturbance is introduced to a cylinder of the plurality of cylinders. The controller may indicate that the cylinder is unhealthy responsive to a difference between the first output and the second output being less than a threshold difference. When an unhealthy cylinder is detected, the controller may adjust one or more operating parameters of the engine, for example engine power may be reduced to reduce a burden placed on the remaining healthy cylinders of the engine.

The output from the crankshaft speed sensor may include time-domain based tooth-to-tooth speed vectors due to the crankshaft speed sensor detecting the passage of each tooth of a wheel coupled to the crankshaft (which may have 90 teeth). To monitor cylinder health, the crankshaft speed sensor output is sampled during cylinder-by-cylinder sequential fuel disturbances, such as over-fueling (referred to as cylinder popping). The sensor output is transformed to the frequency domain using the Discrete Fourier Transform (DFT) bin (e.g., a Goertzel filter) corresponding to the frequency content introduced by a popping cylinder (e.g., half order frequency). The frequency content introduced by a popping cylinder is primarily the frequency at which that cylinder is firing (e.g., once every two revolutions on a 4-stroke engine, once every revolution on a 2-stroke engine). Using the DFT/Goertzel filter may lower processing demands relative to other signal processing techniques (which is beneficial given that the engine control unit is resource limited) and provide a binary "healthy/unhealthy" determination.

The DFT output results in a complex number, the real and imaginary components of may be plotted on a complex plane. As shown in FIGS. 8-13 and described in more detail below, the nominal all healthy cylinders, where no disturbances are occurring, are plotted near the origin of the graph with a value of zero. As other disturbances, in this case dead cylinders, are introduced it distorts the signal, moving away from the origin. If this algorithm needed to work on relatively healthy engines only (e.g., only one cylinder dead) the popping DFT magnitude/phase could be used to determine health of a particular cylinder, or the non-popping DFT could be used to indicate whether dead cylinders exist. However, when the problem is expanded to allow for multiple dead cylinders, or other disturbances, the extent of the healthy/unhealthy data points expand, making a single point evaluation challenging.

Thus, according to embodiments disclosed herein, the change between the not-popping point and popping point is calculated. Assuming all other stressors remain the same, the change should have a magnitude of 0 if the commanded popping cylinder is completely dead (no actual disturbance occurs, despite the command), and should be relatively large if the commanded popping cylinder is healthy. The magnitude of the change is proportional to the strength of the "pop" and may be based on the inertia/friction of the engine. On a heavier engine or one with more frictional losses, the magnitude of change is smaller. The direction of the change is relative to the firing angle of the cylinder under test.

FIG. 1 shows an embodiment of a system including an engine having a plurality of cylinders. Specifically, FIG. 1 shows a block diagram of an embodiment of a vehicle system 100. In the illustrated example, the engine is coupled to a vehicle and is depicted as a rail vehicle 106 (e.g., locomotive). The vehicle may run on a rail 102 via a plurality of wheels 112. As depicted, the vehicle may include an engine 104. The engine may include a plurality of cylinders 101 (only one representative cylinder shown in FIG. 1) that each include at least one intake valve 103, exhaust valve 105, and fuel injector 107. Each intake valve 103, exhaust valve 105, and fuel injector 107 may include an actuator that may be actuated via a signal from a controller 110 of the engine. In other non-limiting embodiments, the engine may be in a stationary platform. Suitable stationary platforms may include a power-plant application. Other suitable vehicles may include a marine vessel, mining or industrial equipment, on-road vehicles, and off-highway vehicle propulsion systems.

The engine may receive intake air for combustion from an intake passage 114. The intake passage 114 may include an air filter 160 that filters air from outside of the vehicle. Exhaust gas resulting from combustion in the engine may be supplied to an exhaust passage 116. Exhaust gas may flow through the exhaust passage, and out of an exhaust stack of the rail vehicle. The exhaust passage may include an exhaust gas sensor 162, which may monitor a temperature and/or an air-fuel ratio of the exhaust gas, and which may be coupled to the controller to provide monitoring data thereto.

In one example, the engine may be a diesel engine that combusts air and diesel fuel through compression ignition. In another example, the engine may be a dual or multi-fuel engine that may combust a mixture of gaseous fuel and air upon injection of diesel fuel during compression of the air-gaseous fuel mixture. In other non-limiting embodiments, the engine may additionally combust fuel including gasoline, kerosene, natural gas, biodiesel, or other petroleum distillates of similar density through compression ignition (and/or spark ignition).

A suitable rail vehicle may be a diesel-electric locomotive. Suitable diesel-electric locomotives may include mainline haulers, heavy haul freight haulers, passenger rail vehicles, shunters, switchers, and the like. The diesel-electric locomotive may include other power sources, such as hybrid electric (batteries), fuel cells, hydrogen engines, and the like. While diesel is used as an example fuel, other fuels may be used. Suitable other fuels may include gasoline, kerosene, ethanol, biodiesel, natural gas, and combinations of the foregoing. As depicted in FIG. 1, the engine may be coupled to an electric power generation system, which includes an alternator/generator 122 and a plurality of electric traction motors 124. For example, the engine may be a diesel and/or natural gas engine that generates a torque output which may be transmitted to the alternator/generator, the alternator/generator being mechanically coupled to the engine. In one embodiment herein, the engine 104 may be a multi-fuel engine operating with diesel fuel and natural gas.

Electrical power produced by the alternator/generator may be stored and applied for subsequent propagation to a variety of downstream electrical components. As an example, the alternator/generator may be electrically coupled to the plurality of electric traction motors and the alternator/generator may provide electrical power to the plurality of electric traction motors. As depicted, each of the plurality of electric traction motors may be coupled to one of the plurality of wheels to provide tractive power to propel the rail vehicle. One example configuration may include one electric traction motor per wheel set (e.g., a subset of the plurality of wheels). As depicted herein, six electric traction motors may correspond to each of six pairs of motive wheels of the rail vehicle. In another example, the alternator/generator may be coupled to one or more resistive grids 126. The resistive grids may dissipate excess engine torque via heat produced by the grids from electricity generated by the alternator/generator. Additionally or alternatively, the resistive grids may be used in dynamic braking mode to dissipate electricity generated by the traction motors.

In some embodiments, the vehicle system may include a turbocharger 120 arranged between the intake passage 114 and the exhaust passage 116. The turbocharger may increase air charge of ambient air drawn into the intake passage to provide greater charge density during combustion to increase power output and/or engine-operating efficiency. The turbocharger may include at least one compressor (not shown) which may be at least partially driven by at least one corresponding turbine (not shown). In some embodiments, the vehicle system may include an aftertreatment system coupled in the exhaust passage upstream and/or downstream of the turbocharger. In one embodiment, the aftertreatment system may include a diesel oxidation catalyst (DOC) and/or a diesel particulate filter (DPF). In other embodiments, the aftertreatment system may additionally or alternatively include one or more emission control devices. Such emission control devices may include a selective catalytic reduction (SCR) catalyst, three-way catalyst, NOx trap, or various other devices or exhaust aftertreatment systems.

As depicted in FIG. 1, the vehicle system may include a thermal management system 150 (e.g., engine cooling system). The cooling system may circulate coolant (e.g., water, glycol, etc.) through the engine to absorb waste engine heat and distribute the heated coolant to a heat exchanger, such as a radiator 152 (e.g., radiator heat exchanger). A suitable coolant may be water. A fan 154 may be coupled to the radiator to maintain an airflow through the radiator when the vehicle is moving slowly or stopped while the engine is running. In some examples, a speed of the fan may be controlled by the controller. Coolant which is cooled by the radiator may enter a tank (not shown). The coolant may then be pumped by a water, or coolant, pump 156 back to the engine or to another component of the vehicle system.

The controller may control various components related to the vehicle. As an example, various components of the vehicle system may be coupled to the controller via a communication channel or data bus. In one example, the controller may include a computer control system. The controller may additionally or alternatively include a memory holding non-transitory computer readable storage media (not shown) including code for enabling on-board monitoring and control of rail vehicle operation. In some examples, the controller may include more than one controller each in communication with one another, such as a first controller to control the engine and a second controller to control other operating parameters of the rail vehicle (such as tractive motor load, blower speed, etc.). The first controller may control various actuators based on output received from the second controller and/or the second controller may control various actuators based on output received from the first controller.

The controller may receive information from a plurality of sensors and may send control signals to a plurality of actuators. The controller, while overseeing control and management of the engine and/or rail vehicle, may receive signals from a variety of engine sensors, as further elaborated herein, in order to determine operating parameters and operating conditions, and correspondingly adjust various engine actuators to control operation of the engine and/or the rail vehicle. For example, the controller may receive signals from various engine sensors including, but not limited to, engine speed, engine load, intake manifold air pressure, boost pressure, exhaust pressure, ambient pressure, ambient temperature, exhaust gas temperature, exhaust gas air-fuel ratio, particulate filter temperature, particulate filter back-pressure, engine coolant pressure, or the like.

Figure 2:
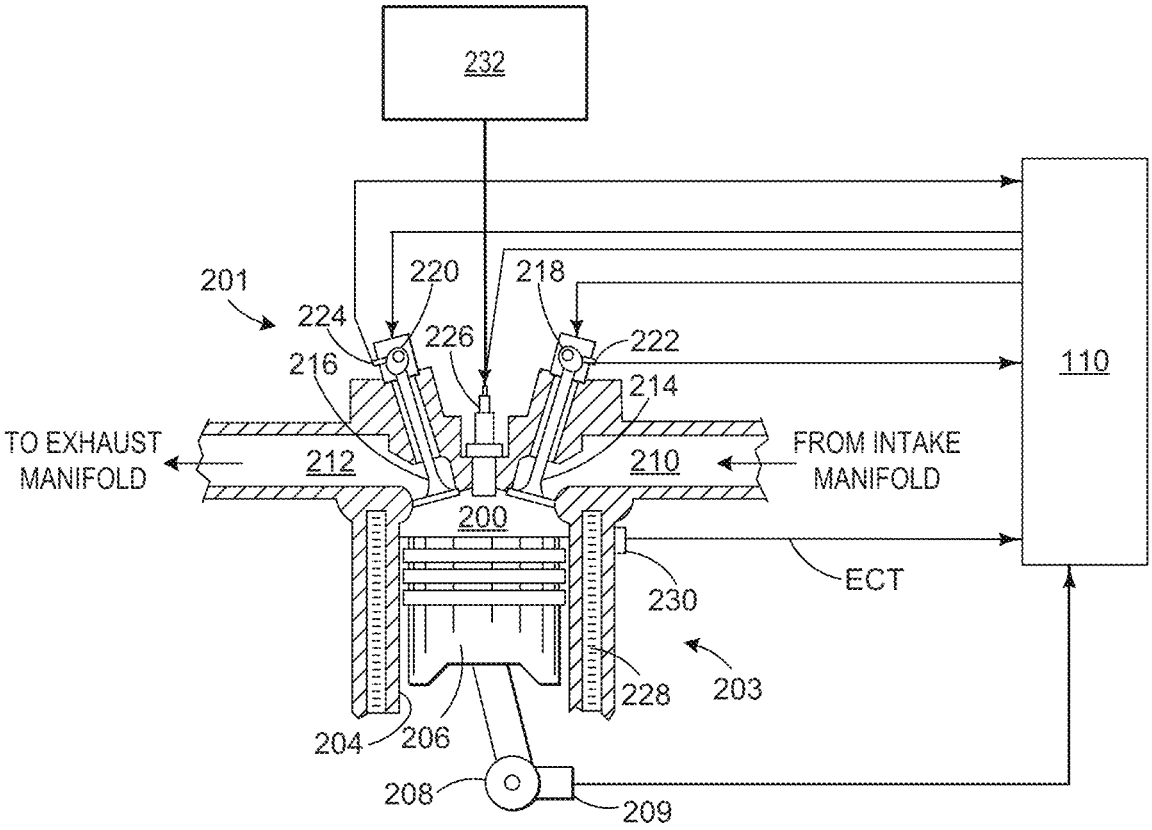
FIG. 2 shows a schematic diagram of a cylinder of the engine of FIG. 1, according to an embodiment of the present disclosure.

FIG. 2 depicts an embodiment of a combustion chamber, or cylinder 200, of a multi-cylinder internal combustion engine, such as the engine 104 described above with reference to FIG. 1. Cylinder 200 may be defined by a cylinder head 201, housing the intake and exhaust valves and fuel injector, described below, and a cylinder block 203. In some examples, each cylinder of the multi-cylinder engine may include a separate cylinder head coupled to a common cylinder block.

The engine may be controlled at least partially by a control system including controller 110 which may be in further communication with a vehicle system, such as the vehicle system 100 described above with reference to FIG. 1. As described above, the controller 110 may further receive signals from various engine sensors including, but not limited to, engine speed from crankshaft speed sensor 209, engine load, boost pressure, exhaust pressure, ambient pressure, CO2 levels, exhaust temperature, NOx emission, engine coolant temperature (ECT) from temperature sensor 230 coupled to cooling sleeve 228, etc. In one example, the crankshaft speed sensor may be a Hall effect sensor, variable reluctance sensor, or linear variable differential transducer configured to determine crankshaft speed based on the speed of one or more teeth on a wheel of the crankshaft. Correspondingly, the controller 110 may control the vehicle system by sending commands to various components such as alternator, cylinder valves, throttle, fuel injectors, etc.

The cylinder (i.e., combustion chamber) 200 may include combustion chamber walls 204 with a piston 206 positioned therein. The piston 206 may be coupled to a crankshaft 208 so that reciprocating motion of the piston is translated into rotational motion of the crankshaft. In some embodiments, the engine may be a four-stroke engine in which each of the cylinders fires in a firing order during two revolutions of the crankshaft 208. In other embodiments, the engine may be a two-stroke engine in which each of the cylinders fires in a firing order during one revolution of the crankshaft 208.

The cylinder 200 receives intake air for combustion from an intake including an intake runner 210. The intake runner 210 receives intake air via an intake manifold. The intake runner 210 may communicate with other cylinders of the engine in addition to the cylinder 200, for example, or the intake runner 210 may communicate exclusively with the cylinder 200.

Exhaust gas resulting from combustion in the engine is supplied to an exhaust including an exhaust runner 212. Exhaust gas flows through the exhaust runner 212, to a turbocharger in some embodiments (not shown in FIG. 2) and to atmosphere, via an exhaust manifold. The exhaust runner 212 may further receive exhaust gases from other cylinders of the engine in addition to the cylinder 200, for example.

Each cylinder of the engine may include one or more intake valves and one or more exhaust valves. For example, the cylinder 200 is shown including at least one intake poppet valve 214 and at least one exhaust poppet valve 216 located in an upper region of cylinder 200. In some embodiments, each cylinder of the engine, including cylinder 200, may include at least two intake poppet valves and at least two exhaust poppet valves located at the cylinder head.

The intake valve 214 may be controlled by the controller 110 via an actuator 218. Similarly, the exhaust valve 216 may be controlled by the controller 110 via an actuator 220. During some conditions, the controller 110 may vary the signals provided to the actuators 218 and 220 to control the opening and closing of the respective intake and exhaust valves. The position of the intake valve 214 and the exhaust valve 216 may be determined by respective valve position sensors 222 and 224, respectively. The valve actuators may be of the electric valve actuation type or cam actuation type, or a combination thereof, for example.

The intake and exhaust valve timing may be controlled concurrently or any of a possibility of variable intake cam timing, variable exhaust cam timing, dual independent variable cam timing or fixed cam timing may be used. In other embodiments, the intake and exhaust valves may be controlled by a common valve actuator or actuation system, or a variable valve timing actuator or actuation system. Further, the intake and exhaust valves may by controlled to have variable lift by the controller based on operating conditions.

In some embodiments, each cylinder of the engine may be configured with one or more fuel injectors for providing fuel thereto. As a non-limiting example, FIG. 2 shows the cylinder 200 is including a fuel injector 226. The fuel injector 226 is shown coupled directly to the cylinder 200 for injecting fuel directly therein. In this manner, fuel injector 226 provides what is known as direct injection of a fuel into combustion cylinder 200. The fuel may be delivered to the fuel injector 226 from a high-pressure fuel system including a fuel tank 232, fuel pumps, and a fuel rail (not shown). In one example, the fuel is diesel fuel that is combusted in the engine through compression ignition. In other non-limiting embodiments, the fuel may be gasoline, kerosene, biodiesel, or other petroleum distillates of similar density through compression ignition (and/or spark ignition). Further, in some examples, each cylinder of the engine may be configured to receive gaseous fuel (e.g., natural gas) alternative to or in addition to diesel fuel. The gaseous fuel may be provided to cylinder 200 via the intake manifold, as explained below, or other suitable delivery mechanism.

Figure 3:
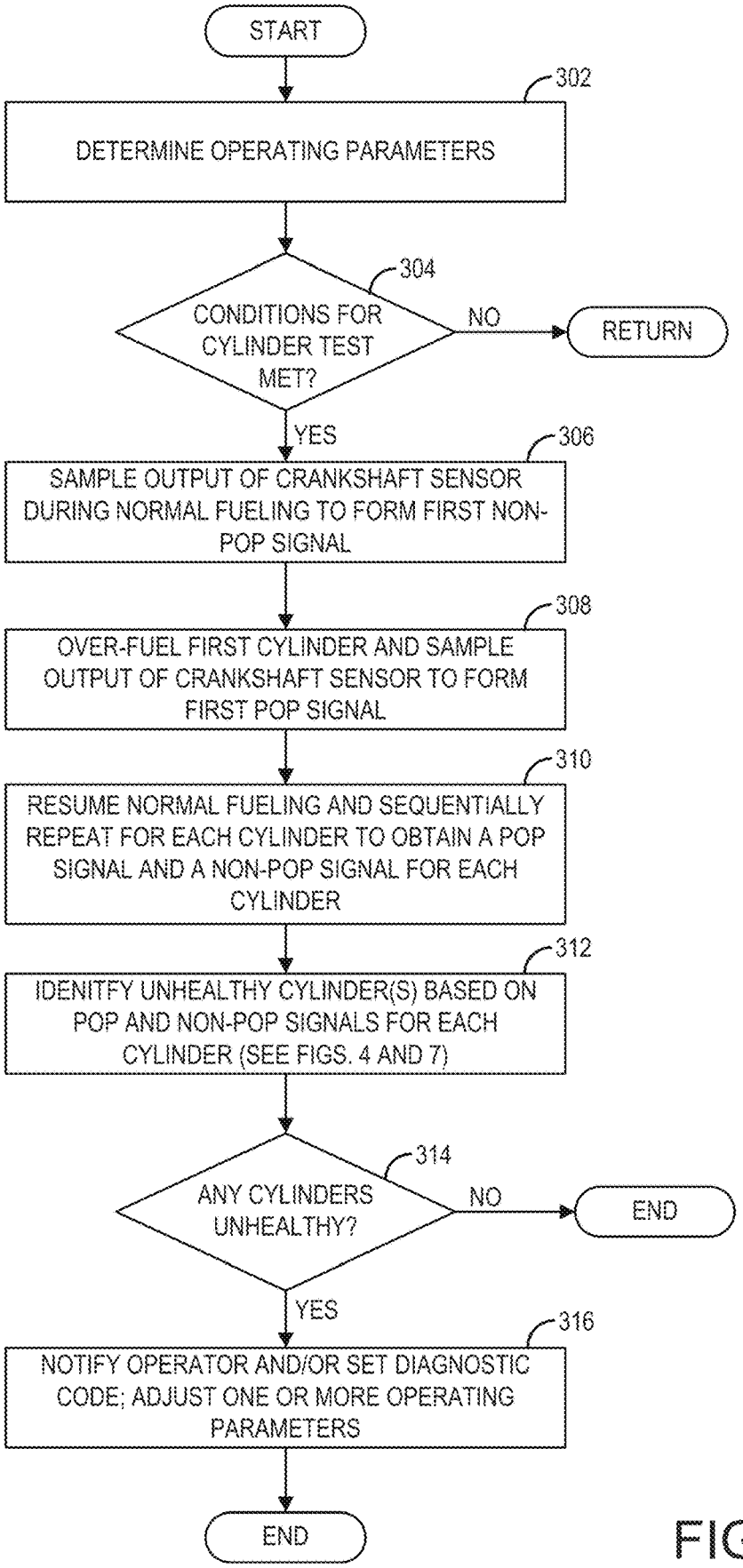
FIG. 3 is a high level flow chart illustrating a method for diagnosing cylinders during a pop test, according to an embodiment of the present disclosure.

FIG. 3 shows a method 300 for diagnosing cylinders via a cylinder test that includes imposing a cylinder-by-cylinder fueling disturbance (herein referred to as a pop test) and performing a spectral analysis of output of a crankshaft speed sensor. Method 300 may be carried out by a controller, such as controller 110 of FIGS. 1-2, according to non-transitory instructions stored thereon and in combination with one or more sensors, such as crankshaft speed sensor 209, as well as one or more actuators (e.g., fuel injectors).

At 302, method 300 includes determining engine operating parameters. The determined parameters may include engine speed, engine load, time since a previous cylinder test was carried out, engine misfire status (e.g., if a misfire is indicated as occurring), and other parameters. At 304, method 300 includes determining if conditions for a cylinder test are met. The conditions for carrying out the cylinder test may include previous identification of cylinder misfire or a threshold amount of time (or distance or engine cycles) having elapsed since a previous cylinder test was carried out. In some examples, the cylinder test may be carried out during low engine speed conditions, such as when the engine is operating at a speed that is less than 440 RPM (e.g., idle speed, which may be 330 RPM in some examples). As such, the conditions for carrying out the cylinder test may include engine idle conditions or during an engine start. Further, in some examples, the cylinder test may be carried out in response to a user request (e.g., entered via user input to a human-machine interface) or the cylinder test may be carried out automatically (e.g., in response to a threshold amount of time having elapsed since a prior cylinder test was executed and in response to engine conditions being met). When the cylinder test is carried out in response to a user request during engine idle conditions, auxiliary loads (e.g., fans, blowers, etc.) may be shut down or disconnected, which may reduce additional disturbances on the engine. However, in some examples, the auxiliary loads may be maintained during the cylinder test.

If the conditions for carrying out the cylinder test are not met, method 300 returns to continue monitor conditions until the conditions are met. Once the conditions are met, method 300 proceeds to 306 to sample the output of the crankshaft sensor during normal fueling to form a first non-pop signal. Normal fueling may include each cylinder receiving approximately an equal amount of fuel. At 308, method 300 includes over-fueling a first cylinder of the engine and sampling the output from the crankshaft sensor to form a first pop signal. When the first cylinder is over-fueled, depending on prevailing engine conditions, an audible pop sound may be detected, and thus the cylinder test may be referred to as a pop test in some examples. In an example, the first cylinder may be over-fueled by a specific amount for a specific duration (e.g., 15-30 seconds). In another example, the first cylinder may be over-fueled using a Set1/Set2 approach, where total torque (or fueling) for the engine is determined by a speed regulator of the controller, and then divided between two sets of cylinders to a desired ratio. During the over-fueling of the first cylinder while carrying out the cylinder test, this ratio is uneven between set1 and set2 cylinders, e.g., set2 may include the first cylinder and set1 may include the remaining cylinders, such that the first cylinder receives an increased amount of fuel (relative to the remaining cylinders) while total torque for the engine is maintained, for a duration that may be dynamically determined based on auxiliary loads placed on the engine or other factors (as explained below with respect to FIG. 7).

When over-fueling, the frequency components of the pop and non-pop signals (explained in more detail below) may show separation that is proportional to the change in torque between the normal and over-fueled cylinders (e.g., set1/set2 cylinders), and thus it may be desirable to maximize the difference in torque between the set1/set2 cylinders. This may be accomplished by over-fueling the set2 cylinders relative to the set1 cylinders, as explained above, but practical limitations to the amount of over-fueling may be present, such as injection duration capabilities and smoke and combustion issues that may arise when air-fuel ratio reaches stoichiometric air-fuel ratio (assuming the engine normally runs lean). Thus, the torque between the set1/set2 cylinders may be further separated by adjusting injection timing between the cylinder sets. For example, the over-fueled cylinder (set2) may have injection timing advanced while increasing air-fuel ratio to limit smoke production. The normal cylinders (set1) may have high air-fuel ratio owing to the normal fueling and thus smoke is not a concern. Accordingly, fuel injection timing for the normal cylinders during over-fueling may be retarded. Thus, during the over-fueling, the over-fueled cylinder may be adjusted to have advanced fuel injection timing and the normal cylinders may be adjusted to have retarded injection timing (each relative to nominal injection timing for the commanded torque), which may allow for increased torque separation while minimizing the total amount of fuel needed to realize the increased torque in the over-fueled cylinder. In doing so, the over-fueled cylinder may have a higher air-fuel ratio (relative to if injection timing was maintained and further fuel was provided to increase torque), thereby lowering smoke production and minimizing combustion issues. Further, while a sequential over-fueling process is described herein, it is to be appreciated that other fueling disturbances may be introduced in a similar manner, rather than over-fueling each cylinder. For example, each cylinder may be sequentially under-fueled such that each cylinder receives a decreased amount of fuel relative to remaining cylinders, in a cylinder-by-cylinder fashion.

While the first pop signal is described herein as being obtained after the first non-pop signal is obtained, in some examples, the first pop signal may be obtained before the first non-pop signal is obtained. However, obtaining the first non-pop signal before the first pop signal is obtained may reduce the overall time the test is active owing to fewer transitions since the starting point may also be the baseline point. At 310, normal fueling is resumed and the process is sequentially repeated for each cylinder of the engine, such that each cylinder is over-fueled with a normal fueling excursion between each over-fueling event, and the crankshaft sensor output is sampled during each normal fueling and over-fueling excursion to obtain a non-pop signal (indicative of the crankshaft sensor output during normal/equal fueling) and a pop signal (indicative of the crankshaft sensor output during the over-fueling) for each cylinder of the engine.

At 312, one or more unhealthy cylinders may be identified based on the pop and non-pop signals for each cylinder. Additional details regarding how the unhealthy cylinder(s) are identified based on the pop and non-pop cylinders are presented below with respect to FIGS. 4 and 7. Briefly, the pop and non-pop signals may be transformed to the frequency domain and the half-order frequency component (or another suitable frequency component) may be analyzed to determine if the increased torsional vibrations placed on the crankshaft during the over-fueling are present. If an increase in the torsional vibrations is not identified for a particular cylinder, that cylinder may be deemed unhealthy (e.g., due to the cylinder not receiving sufficient fuel, due to the cylinder not fully compressing, or another issue that prevents full combustion). During the low engine speed conditions of the cylinder test, a cylinder that is unhealthy (e.g., misfiring) may be indistinguishable from a healthy cylinder. However, when a cylinder is over-fueled during the low engine speed conditions, the half-order amplitude increases, which may be detected as explained below.

At 314, method 300 determines if any of the cylinders are identified as unhealthy. If no cylinders are identified as unhealthy (e.g., all the cylinders are healthy), method 300 ends. Because the cylinders are healthy, no adjustments to engine operating parameters are made and current engine operating parameters may be maintained. In some examples, an operator may be notified that all the cylinders are healthy and/or the healthy status of the cylinders may be stored in memory of the controller. However, any of the cylinders are determined to be unhealthy, method 300 proceeds to 316 to notify the operator of the unhealthy cylinder(s) and/or set a diagnostic code indicating the unhealthy cylinder(s). In some examples, one or more operating parameters may be adjusted in response to the identification of the unhealthy cylinder(s). The adjusted operating parameters may include adjusting fuel injection parameters of the unhealthy cylinder (s), such as adjusting an amount, duration, and/or timing of fuel injection to the unhealthy cylinder(s). For example, fueling may be ceased to the unhealthy cylinder, and engine torque may be maintained by increasing fueling to the healthy cylinders. Other operating parameter adjustments may include exhaust gas recirculation amount, boost pressure, etc. Further still, responsive to the identification of the unhealthy cylinders, the engine may be derated (e.g., engine load/power for each healthy cylinder may be reduced) or shut down to avoid engine degradation. Method 300 then returns.

Thus, if a cylinder is cut out, or stops functioning, the crankshaft acceleration contribution from that cylinder will be less than the rest of the contributing cylinders. For a V12, four stroke engine, each cylinder fires once every other revolution of the crankshaft. Therefore, each cylinder will have a specific acceleration contribution on the crankshaft. This specific acceleration can be identified in a half order spectral analysis of the crankshaft speed sensor. Similarly, if one cylinder starts to over-fuel for some reason, the contribution onto the crankshaft will once again be specific and thus identifiable in a spectral analysis of the crankshaft speed sensor.

Once the cylinder degradation is identified, the control system may take necessary adjustments to optimize engine performance, efficiency, and emissions compliance routines. If indicated, the control system may also cut all fueling to the degraded cylinder to help protect the engine of any further secondary degradation that may occur.

At low engine speeds, it is typical for healthy cylinders to misfire, as the injectors are at the low end of their operational range. This makes it difficult to detect a cut out cylinder using spectral analysis, as the power levels seen between a healthy engine and an engine with a cut out cylinder are overlapping and there is no clear separation that may be used to identify the cut out cylinder. The method described above with respect to FIG. 3 overcomes these obstacles by combining spectral analysis with a pop test. During a pop test, each cylinder is over-fueled in a specific order. A healthy cylinder being over-fueled will have a relatively high half-order power level, while a cut out cylinder will have a relatively low half-order power level. The control system may utilize this separation in power levels to determine health of the individual cylinders at low engine speeds. Once the control system determines there is a cylinder working at less than full health, it can then take specific action around that cylinder to either optimize performance of the engine given a compromised cylinder or cut fueling to that cylinder to help protect the engine from further degradation. For example, an engine controller system can take action to adjust EGR rates and valves accordingly to adequately compensate for a lack of an injector firing as intended. This adjustment could be made to help maintain emissions compliance to a certain degree even with a compromised system. The controller could also derate overall load or power on the engine to help mitigate progression of a degradation and allow the vehicle enough opportunity to limp back home.

Figure 4:
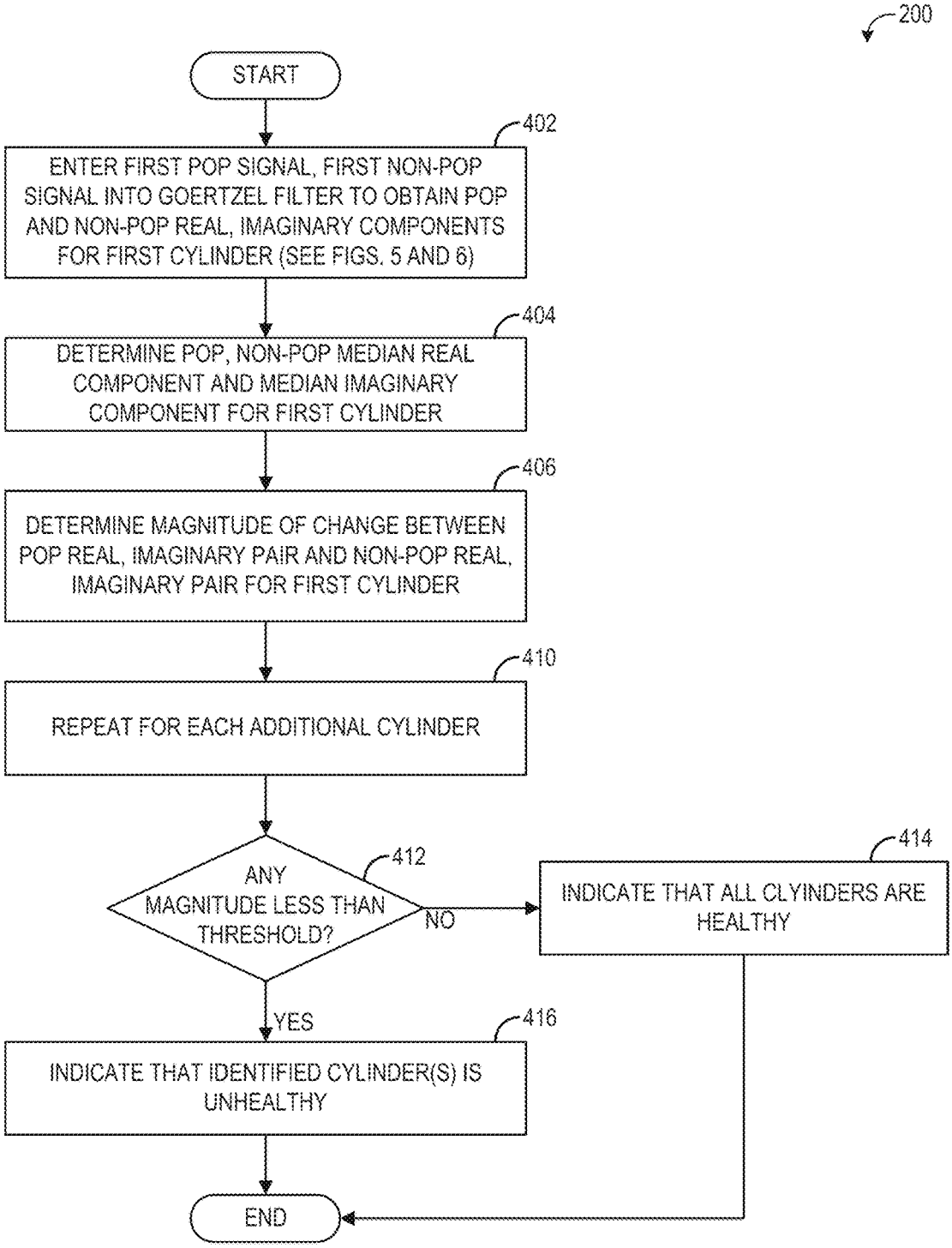
FIG. 4 is a flow chart illustrating a method for diagnosing cylinders based on frequency components of a signal output by a crankshaft speed sensor during a pop test, according to a first embodiment of the present disclosure.

FIG. 4 is a flow chart illustrating a method 400 for diagnosing cylinders by performing a spectral analysis of output from a crankshaft sensor, according to a first embodiment of the disclosure. Method 400 may be carried out a control unit, such as controller 110, according to non-transitory instructions stored thereon. Method 400 may detect half-order or higher torsion vibrations, alone or in combination. In one example, method 400 may only detect half-order torsional vibrations, for example when the engine is a four-stroke engine. In other examples, method 400 may detect first order torsional vibrations, for example when the engine is a two-stroke engine. Detection of other torsional vibration orders are within the scope of this disclosure.

At 402, method 400 includes entering a first pop signal and first non-pop signal into a Goertzel filter to obtain pop and non-pop real and imaginary components, for a first cylinder of an engine. The first pop signal and the first non-pop signal may be obtained as described above with respect to FIG. 3, e.g., from the crankshaft sensor during over-fueling and normal fueling, respectively, of the first cylinder. Auxiliary loads, such as air compressors, cooling fans, and the like, may be deactivated while obtaining the pop and non-pop signals to reduce possible disturbances. The first pop signal and first non-pop signal may include information indicative of an amount of time (Xn) between the passing of each tooth of a crankshaft wheel past a crankshaft sensor for one or more full engine cycles (e.g., two revolutions of the crankshaft). In one example, the crankshaft wheel may include a plurality of teeth, and the amount of time between when a first tooth and a second, adjacent tooth passes by the crankshaft sensor may be determined for each tooth of the wheel. In one example, the wheel may include 90 teeth, and thus approximately 180 Xn samples may be collected in an engine cycle.

Each value of Xn is input into the Goertzel filter. Additional details regarding the Goertzel filter is described below with respect to FIG. 5. Briefly, the Goertzel filter calculates a term (Sn) for each Xn that is based on a previous two Xn terms and a calibratable coefficient. The final two terms of the Goertzel filter, $S_N$ and $S_{N-1}$, are output at a given frequency and used to determine a real component and an imaginary component for each signal, additional details of which are presented below with respect to FIG. 6. Briefly, the plurality of Xn samples collected during the engine cycle represent a signal that may be processed to determine the real and imaginary components of the signal. Based on the real and imaginary components of the pop signal relative to the non-pop signal, it may be determined if the cylinder is healthy. The real and imaginary components may be determined at a given frequency, such as once per second (e.g., 1 Hz). As described above with respect to FIG. 3, the first pop signal may be obtained while the first cylinder is over-fueled for a specific duration, such as 15-30 seconds, and the first non-pop signal may be obtained for a similar duration. Portions of the pop and non-pop signals obtained during and near a mode transition (e.g., from normal fueling to over-fueling and vice versa) may be discarded and a portion of each signal in the middle of the over-fueling or normal fueling duration may be entered into the Goertzel filter. Thus, a plurality of real and imaginary components (e.g., 5-15) may be output for the first pop signal and a corresponding plurality of real and imaginary components (e.g., 5-15) may be output for the non-pop signal.

At 404, method 400 includes determining a median real component and a median imaginary component for the pop signal and a median real component and a median imaginary component for the non-pop signal for the first cylinder of the engine. The median real and imaginary components for the pop and non-pop signals may be calculated using a median of the components gathered during the output for the pop and non-pop signals (e.g., the median of all the real components of the pop signal may be determined, the median of all the imaginary components of the pop signal may be determined, etc.).

At 406, method 400 includes determining a magnitude of change between the pop real, imaginary component pair and the non-pop real, imaginary component pair for the first cylinder of the engine. For example, an absolute value of a difference between the pop real, imaginary pair and the non-pop real, imaginary pair may be determined.

In some examples, the magnitude of change may be represented as a vector from the non-pop real and imaginary pair to the pop real and imaginary pair, where the magnitude and direction of the vector may be plotted to show an absolute value of difference between the component values. An example of a graph showing absolute values plotted as described above is shown in FIG. 9 and explained in more detail below. In this way, the magnitude of change between the half-order frequency components of the pop signal and the half-order frequency components of the non-pop signal may be calculated. In some examples, the magnitude of change may be calculated as the square root of a sum of the squared difference between the pop and non-pop real components and the pop and non-pop imaginary components.

At 410, method 400 includes sequentially repeating 402, 404, and 406 for each additional cylinder in the engine. Unless aborted by an operator, all cylinders may be tested when method 400 is initiated. At 412, method 400 includes determining if any of the calculated magnitudes of change is less than a threshold value. The threshold value may be selected based on average magnitudes of change for healthy cylinders, such that a magnitude of change below the threshold value may indicate an unhealthy cylinder. In some examples, the threshold may additionally or alternatively be selected to balance the risk of falsely declaring a cylinder unhealthy (which drives unneeded maintenance/false alarms) with missing a dead cylinder.

If none of the calculated magnitudes of change is below the threshold value, method 400 proceeds to 414 to indicate that all cylinders are healthy, and then method 400 ends. However, if one or more of the magnitudes of change is less than the threshold value, method 400 proceeds to 416 to indicate that the identified cylinder(s) having the magnitude of change below the threshold is unhealthy.

Thus, method 400 provides for a cylinder test that may be executed in response to a user request during engine idling. During the cylinder test of method 400, all auxiliary loads placed on the engine (e.g., fans, blowers, compressors) may be deactivated and each cylinder may be over-fueled (one at a time) in a sequential manner via a fixed duration adder on the fuel command for the over-fueled cylinder. The controller may maintain a set engine speed (e.g., 330 RPM) during the sequential over-fueling. The crankshaft speed sensor output may be obtained during the over-fueling events and normal fueling excursions between the over-fueling events and entered into a Goertzel filter to obtain DFT bin real and imaginary components corresponding to the once per engine cycle frequency, and that calculation is updated at a given frequency (e.g., 1 Hz). The medians of the real and imaginary components are used to calculate a magnitude of change between popping and non-popping for each cylinder (e.g., via the square root of the sum of the squared differences). Each magnitude of change is compared to a precalibrated threshold to determine the respective cylinder is healthy or unhealthy. Each cylinder is tested each time the cylinder test is initiated, unless the cylinder test is aborted by an operator. Further, engine timing may be overridden during the cylinder test.

While determining healthy versus unhealthy cylinders is described herein as being based on the magnitude of change of the real, imaginary pairs for the popping and non-popping signals, other methods may be employed in addition or alternative to the magnitude of change. For example, each change vector described herein has a direction that is dependent on the engine position at the time that cylinder is fired (e.g., the firing angle of the cylinder). The direction of the change vector calculated for a given cylinder may be analyzed to confirm that the cylinder test was performed correctly. For example, each change vector should have a direction that corresponds to the firing angle of that cylinder, and thus if a direction of a change vector conflicts with the firing angle of that cylinder, it may be indicative that the test is invalid. Further, if a change vector direction cannot be determined, it may be indicative that the cylinder is unhealthy (e.g., the change vector is too small to confidently determine its direction).

Figure 5:
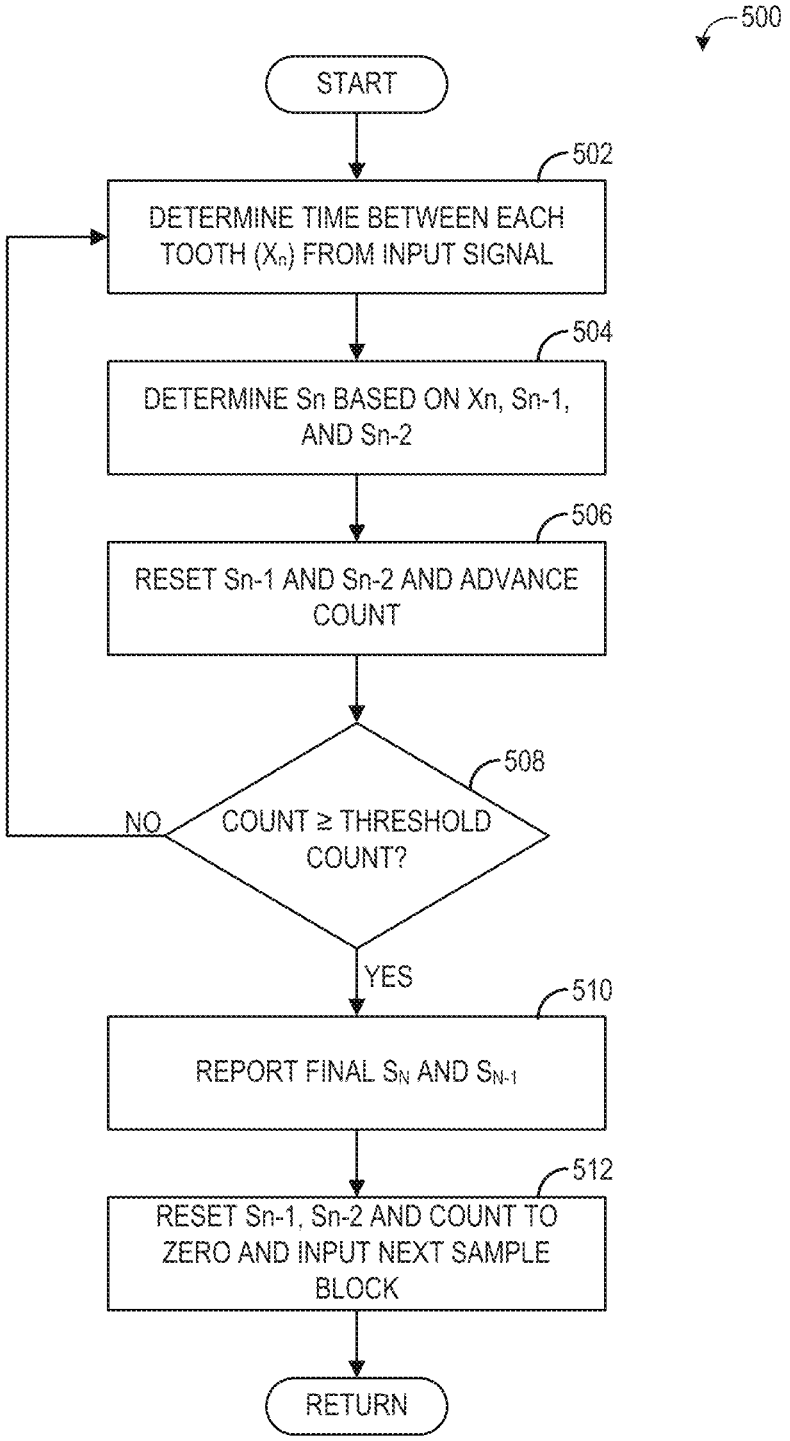
FIGS. 5 and 6 are flow charts illustrating a method for obtaining real and imaginary frequency components, according to an embodiment of the present disclosure.

Referring to method 500 of FIG. 5, it illustrates the sample collection and recursive summation performed on the crankshaft sensor signal via the Goertzel filter. As explained previously, the engine crankshaft has a timing wheel with evenly spaced teeth to control the injection of the fuel at the correct angular position of the engine. The passage of each tooth is read by the controller. Even though the teeth are evenly spaced, the time between teeth, DT(n) (also referred to $X_n$) varies due to the torsional oscillation of the crankshaft caused by the pulsating nature of individual cylinders firing and the elastic properties of the crankshaft. When all the cylinders fire evenly, their torque impulses into the crankshaft are fairly equal and the phase difference between the cylinders result in a low, net value of the lower torsional orders. When one cylinder's torque is lower or higher, then the rest of the torque values do not cancel out, and a higher net value of the crankshaft torsional orders can be calculated. Method 500 may be performed as part of method 400 or as part of method 700 (described in more detail below) in order to generate the terms used to calculate the real and imaginary components of the pop and non-pop signals for each cylinder of the engine.

Thus, at 502, method 500 includes obtaining an $X_n$ value calculated as described above (e.g., the amount of time between when the crankshaft speed sensor detects a first tooth and when the sensor detects a second tooth, where the second tooth is the immediately adjacent tooth to the first tooth). At 504, a first term $S_n$, is determined based on $X_n$, $S_{n-1}$, and $S_{n-2}$. To determine $S_n$, the obtained $X_n$ value is entered into the equation $S_n=X_n+\text{Coeff}^*-S_{n-1}-S_{n-2}$, where the value of coeff depends on the order being calculated (e.g., half-order, first order, etc.) and where $S_{n-1}$, and $S_{n-2}$ are the prior two calculated $S_n$. After $S_{n-1}$ is calculated, $S_{n-1}$ is set to $S_{n-2}$, $S_n$ is set to $S_{n-1}$, and the sample count is incremented by one at 506. It is then determined at 508 if the sample count is equal to or greater than a threshold count. The threshold count may be the number of teeth that the sensor detects in one full engine cycle (e.g., two rotations of the crankshaft and thus two times the number of teeth on the wheel), or other suitable count that indicates enough data has been collected to enable a determination of the torsional vibration order(s). In one example where the wheel has 90 teeth, the count may be 180. In another embodiment, the controller may read, via the crankshaft sensor, more than one tooth of the timing wheel at a time. For example, the crankshaft sensor may capture four teeth at a time. As a result, the controller may read 45 samples for a crankshaft wheel having 90 teeth. In another example, if the crankshaft wheel has 90 teeth and the controller can capture two teeth at a time, then 90 samples may be taken. In this way, the count may change based on the number of teeth sampled at one time.

If the count is not greater than the threshold count, method 500 loops back to 502 and $S_n$ is calculated for the next $X_n$. If the count is equal to or greater than the threshold count, the two final terms, $S_N$ and $S_{N-1}$, are output at 510, and all the values are reset to zero at 512 to start over for a next engine cycle. In this way, the sum is performed for all the teeth in two revolutions of the crankshaft, and then the real and imaginary components are calculated (described below).

Figure 6:
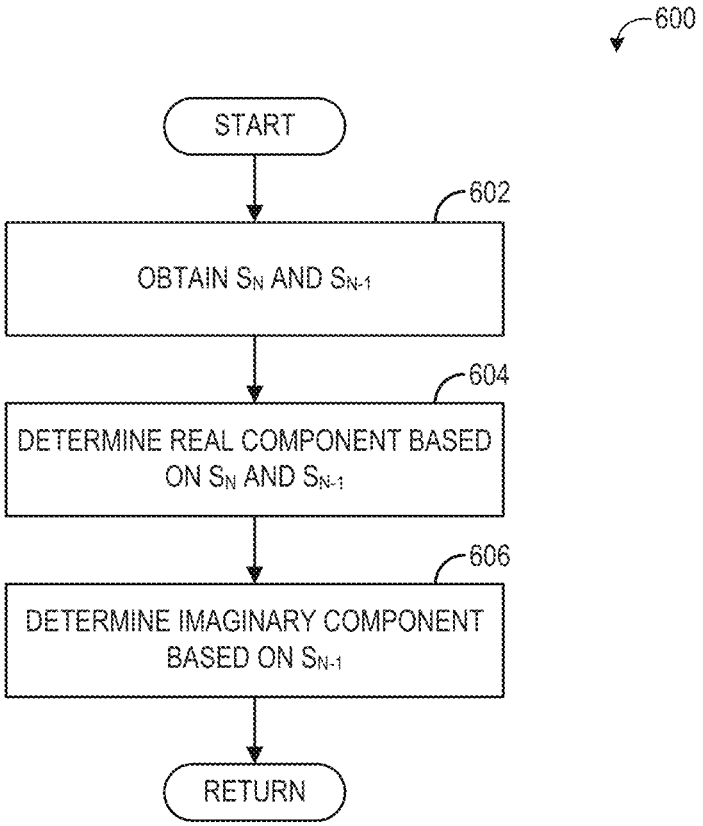

FIG. 6 is a flow chart illustrating a method 600 for determining the real and imaginary components of the pop and non-pop signals based on the terms output by method 500. At 602, method 600 includes obtaining $S_N$ and $S_{N-1}$. As explained above with respect to FIG. 5, $S_N$ and $S_{N-1}$ are the final two terms output from the recursive Goertzel algorithm. As such, $S_N$ and $S_{N-1}$ represent the desired frequency component (e.g., half order) for the entire sampled signal, and include real and imaginary frequency components. At 604, the real component is determined based on $S_N$ and $S_{N-1}$. The real component may be determined according to the equation:

$$\text{real}=(S_N-S_{N-1}*\text{cosine})$$

At 606, the imaginary component is determined based on $S_{N-1}$. The imaginary component may be determined according to the following equation:

$$\text{imaginary}=(S_{N-1}*\text{sine})$$

It should be appreciated that methods 500 and 600 may be performed for each pop signal and each non-pop signal obtained during the cylinder test of method 400 or method 700. Thus, real and imaginary components are output via methods 500 and 600 at the frequencies described herein for each cylinder of the engine, while each cylinder is popping and not popping.

Figure 7:
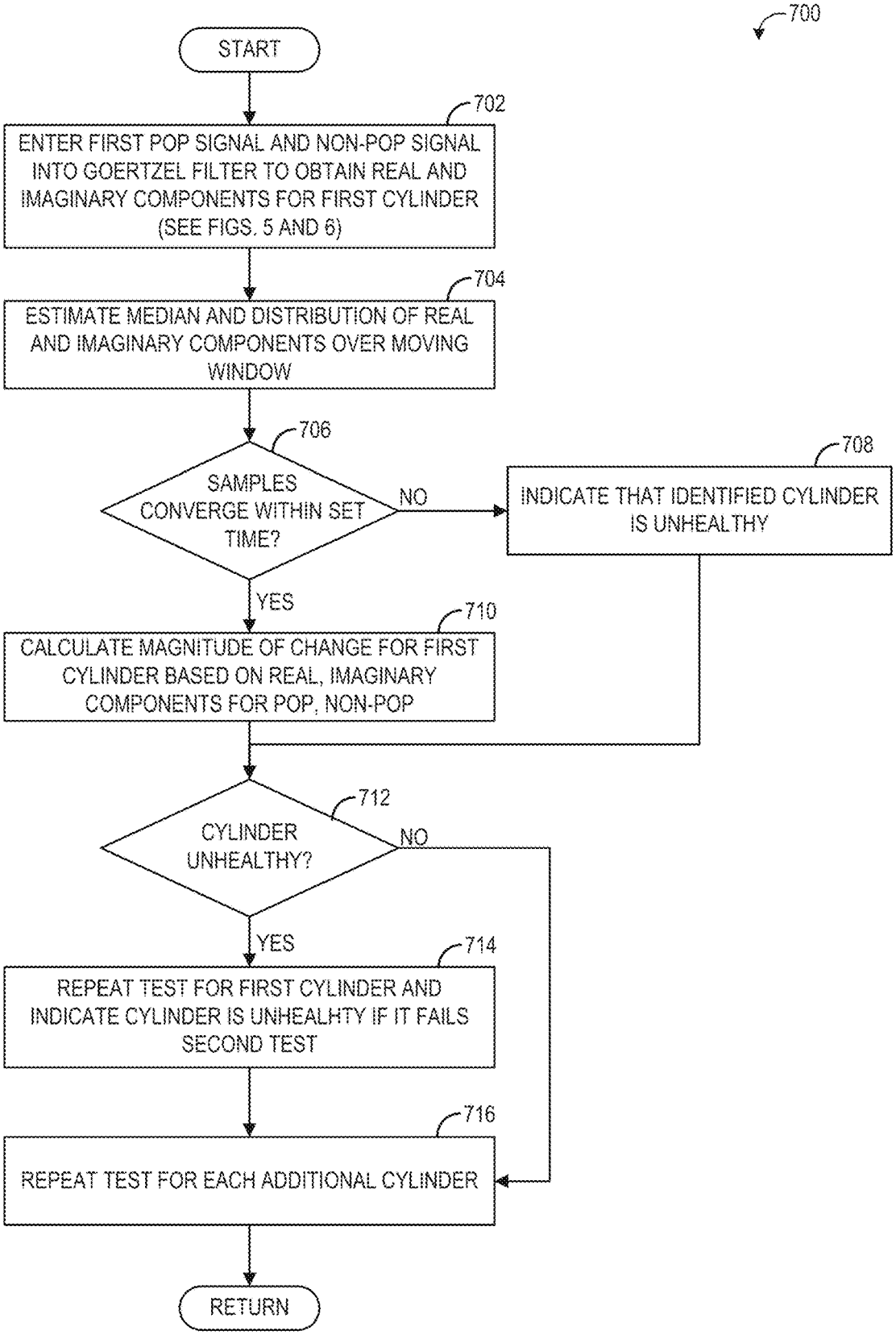
FIG. 7 is a flow chart illustrating a method for diagnosing cylinders based on frequency components of a signal output by a crankshaft speed sensor during a pop test, according to a second embodiment of the present disclosure.

FIG. 7 is a flow chart illustrating a method 700 for diagnosing cylinders by performing a spectral analysis of output from a crankshaft sensor, according to a second embodiment of the disclosure. Method 700 may be carried out a control unit, such as controller 110, according to non-transitory instructions stored thereon. Method 700 may detect half-order or higher torsion vibrations, alone or in combination. In one example, method 700 may only detect half-order torsional vibrations, for example when the engine is a four-stroke engine. In other examples, method 700 may detect first order torsional vibrations, for example when the engine is a two-stroke engine. Detection of other torsional vibration orders are within the scope of this disclosure. Method 700 may be performed automatically in response to a determination that conditions for carrying out the cylinder test have been met, e.g., as part of method 300 explained above.

At 702, method 700 includes entering a first pop signal and a first non-pop signal into a Goertzel filter to obtain pop and non-pop real and imaginary components, for a first cylinder of an engine. The first pop signal and the first non-pop signal may be obtained as described above with respect to FIG. 3, e.g., from the crankshaft sensor during over-fueling and normal fueling, respectively, of the first cylinder. The real and imaginary components may be calculated at a frequency corresponding to the once per engine cycle frequency, and that calculation may be updated periodically at a given frequency, such as ten times per second (e.g., 10 Hz). As described above with respect to FIG. 3, the first pop signal may be obtained while the first cylinder is over-fueled and the first non-pop signal may be obtained while the first cylinder is not over-fueled. However, unlike the method of FIG. 3, the over-fueling (and corresponding collection of the pop signal) that is performed in method 700 is not performed for a predetermined duration. Rather, the over-fueling is performed and the pop signal is collected until signal convergence is observed, which indicates that any external disturbances that may be acting on the signal (e.g., auxiliary loads being added/removed) have stabilized. In this way, when the over-fueling of the first cylinder is performed, the pop signal may be obtained and continuously input into the Goertzel filter to obtain the pop real and imaginary components at a given update frequency (e.g., 10 Hz). When norming fueling is resumed, the non-pop signal is obtained and continuously input to the Goertzel filter to obtain the non-pop real and imaginary components at a given update frequency (e.g., 10 Hz)

At 704, method 700 includes estimating a median and a distribution of real and imaginary components for the pop and the non-pop signals over a moving window of a fixed number of output samples. The samples may be the received real and imaginary components. The distribution of the real and imaginary components may be a determined absolute deviation from the median.

At 706, method 700 includes determining if the samples converge within a set time.

Convergence may be defined as the median absolute deviation of the real and imaginary components for the pop and non-pop signals (e.g., the median of the absolute values of the deviations from the median of the samples) being below a calibrated threshold. Convergence may be indicated once the samples are consistent, which may be achieved when disturbances such as auxiliary loads (e.g., air compressors) are no longer present and/or changing. The set time may be 30 seconds or another suitable time that may be determined empirically.

If the samples do not converge within the set time, method 700 proceeds to 708 to indicate that the first cylinder is unhealthy. The samples not converging may be defined by the median absolute deviation of the real and imaginary components for the pop and non-pop signals not being below the calibrated threshold. If the samples do not converge within the set time, it may be indicative that the cylinder is unhealthy, which may trigger a re-test of the cylinder (explained below).

If the samples converge within the set time, method 700 proceeds to 710, which includes calculating a magnitude of change for the first cylinder based on the real and imaginary components for the pop signal and the real and imaginary components for the non-pop signal. The magnitude of change may be represented as a vector from the non-pop real and imaginary components to the pop real and imaginary components, where the magnitude and direction of the vector may be plotted to show an absolute value of difference between the component values. The magnitude of change may be calculated as described above with respect to FIG. 4. The magnitude of change may be compared to a threshold value to determine if the cylinder is healthy or unhealthy, as explained above. If the magnitude of change is less than the threshold value, the cylinder may be indicated as being unhealthy.

At 712, method 700 includes determining if the cylinder is healthy. The cylinder may be determined healthy if the samples converged within the set time and the magnitude of change is greater than the threshold value. The cylinder may be determined to be unhealthy if the samples did not converge within the set time and/or the magnitude of change is not greater than the threshold value. If the cylinder is not determined to be unhealthy (e.g., the cylinder is healthy), method 700 proceeds to 716, which is explained below. If the cylinder is determined to be unhealthy, method 700 proceeds to 714 repeat the test for the first cylinder and indicate that the cylinder is unhealthy if it fails the second test. In one example, a repeated test may include collecting new pop and non-pop signals for the cylinder that is being retested. In this way, if a cylinder fails two successive tests, it may be indicated as unhealthy.

At 716, method 700 includes repeating cylinder tests for each additional cylinder in the engine. As each cylinder is tested, indicators of the health of each cylinder may be logged. Method 700 may end.

Thus, method 700 provides for a cylinder test that may be executed automatically (e.g., without explicit user input) during low engine speed conditions. During the cylinder test of method 700, auxiliary loads placed on the engine (e.g., fans, blowers, compressors) may be added, maintained, or removed based on the demands of each auxiliary load and each cylinder may be over-fueled (one at a time) in a sequential manner via a set1/set2 fueling approach for the over-fueled cylinder. The controller may maintain a set gross indicated torque on the popping cylinder during the sequential over-fueling. The crankshaft speed sensor output may be obtained during the over-fueling events and normal fueling excursions between the over-fueling events and entered into a Goertzel filter to obtain DFT bin real and imaginary components at a given frequency (e.g., 10 Hz). However, only unique cycles may be used for calculations by doing all calculations on an event sampled basis (only using one time step of a new engine cycle). The duration of the collection of the crankshaft sensor output (as well as the duration of the popping and non-popping for each cylinder) may be dynamic in order to ensure the sensor is sampled when disturbances from auxiliary loads are not present. To accomplish this, a moving window of a fixed number of DFT samples (e.g., the real and imaginary components) may be analyzed to estimate the center (median) and the spread (median absolute deviation) of the real/imaginary components of the point being tested. A measurement point is tested until "convergence" as determined by the median absolute deviation of the sampled points being below a calibrated limit. This "waits" until disturbances to the feedback signal such as auxiliary loads like the air compressor are no longer present and the sampled data is consistent.

Once the samples converge, the medians of the real and imaginary components are used to calculate a magnitude of change vector between popping and non-popping for each cylinder (e.g., via the square root of the sum of the squared differences). Each magnitude of change vector is compared to a precalibrated threshold to determine the respective cylinder is healthy or unhealthy. Further, a cylinder may be diagnosed as unhealthy if the samples never converge (for that cylinder), or the magnitude of change in the DFT does not exceed the threshold versus its baseline point. In some examples, the test may re-baseline if a cylinder is detected unhealthy, and then the cylinder is retested. Two successive failures (on two baselines) may be observed to declare a cylinder unhealthy.

In some examples, when an unhealthy cylinder is detected, power may be limited proportionally to the number of detected unhealthy cylinders. If one cylinder is unhealthy on a 16 cylinder engine, then the power is restricted to 15/16ths of the nominal notch call to maintain the power levels on the other cylinders at nominal levels. In some examples, during the cylinder test, engine timing and rail pressure may be overridden during the test. During baselining (e.g., non-popping), the cylinder test may include all cylinders into a single set with consistent fueling across all cylinders. The test may look for sufficient separation between Set1 and Set2 cylinder torques during popping points as a criterion for a valid test point. For example, if a difference between the cylinder torques for the set1/set2 cylinders is lower than a threshold, the test may be considered invalid and a new test may be performed. To increase separation in the cylinder torques, the fuel injection timing may be adjusted between the cylinders, e.g., the set2 cylinder (popping cylinder) may have advanced timing relative to the set1 cylinders.

The automatic cylinder test of method 700 may be executed based on a time since a last test being carried out, or if the controller has been recently rebooted. If any cylinder has not been diagnosed since the controller reboot, the test will be executed when conditions allow. Further, if any cylinder has not been diagnosed for greater than a calibrated limit, the test may be executed when conditions allow.

In some examples, the cylinder test may only test cylinders which have not been diagnosed for greater than a calibrated time limit. The test may not diagnose the entire engine at once, and the test may be interrupted by nominal engine operation. The controller may opportunistically start the test when the vehicle is not in use (e.g., idle power for a threshold time). Auxiliary loads are not disabled during the cylinder test, and transients are rejected by use of the convergence criteria on the output samples. The controller may look for a low enough torque demand prior to executing the test such that sufficient separation between Set1 and Set2 cylinder torques is expected. The test may be executed at multiple engine speeds (335 RPM, 440 RPM, or 580 RPM). The magnitude of the calibrated thresholds/override values utilized in the test (popping cylinder torque, health thresholds, etc.) may be selected based on engine speed. The cylinder health threshold (e.g., the threshold value to which the magnitude of change vectors are compared) may be selected based on engine speed and the pop magnitude.

While the cylinder tests described herein (e.g., in methods 400 and 700) are carried out by over-fueling cylinders, it is to be appreciated that a similar approach could be used with a different type of commanded disturbance, such as sequentially cutting fuel to each cylinder rather than sequentially over-fueling each cylinder. Further, rather than disturbing one cylinder at a time and analyzing the half-order frequency components, multiple cylinders could be disturbed at once (e.g., two cylinders over-fueled at a time) and a different frequency component analyzed (e.g., over-fueling N cylinders at a time and looking at the 1/Nth frequency content). Further still, alternative signal processing techniques could be applied, such as RMS error, cross correlation, wavelet analysis, etc., so long as the results are compared to a pre-calibrated signature. Evaluation of poor cylinder health may be used to determine a power limit for the engine. This will reduce the time operating while overpressuring the remaining healthy cylinders by continued operation at rated power.

The pop/non-pop comparison for each cylinder (regardless of method of comparison, DFT or otherwise) is correlated to the relative strength (torque generated during a pop) of a cylinder and may be trended over time to enable condition based maintenance. The pop/non-pop comparison for each cylinder may be used to compare the relative strength (torque generated during a pop) of cylinders in the engine, which may be used as a feedback mechanism for balancing engine loads between cylinders. Additionally, the pop/non-pop comparison for each cylinder or the mean/median of all cylinders may be used to estimate physical characteristics (e.g. inertia) of the engine, given a knowledge of the commanded pop size, which may be used as a feedback mechanism for dynamically adjusting the speed regulator tuning.

Figure 8:
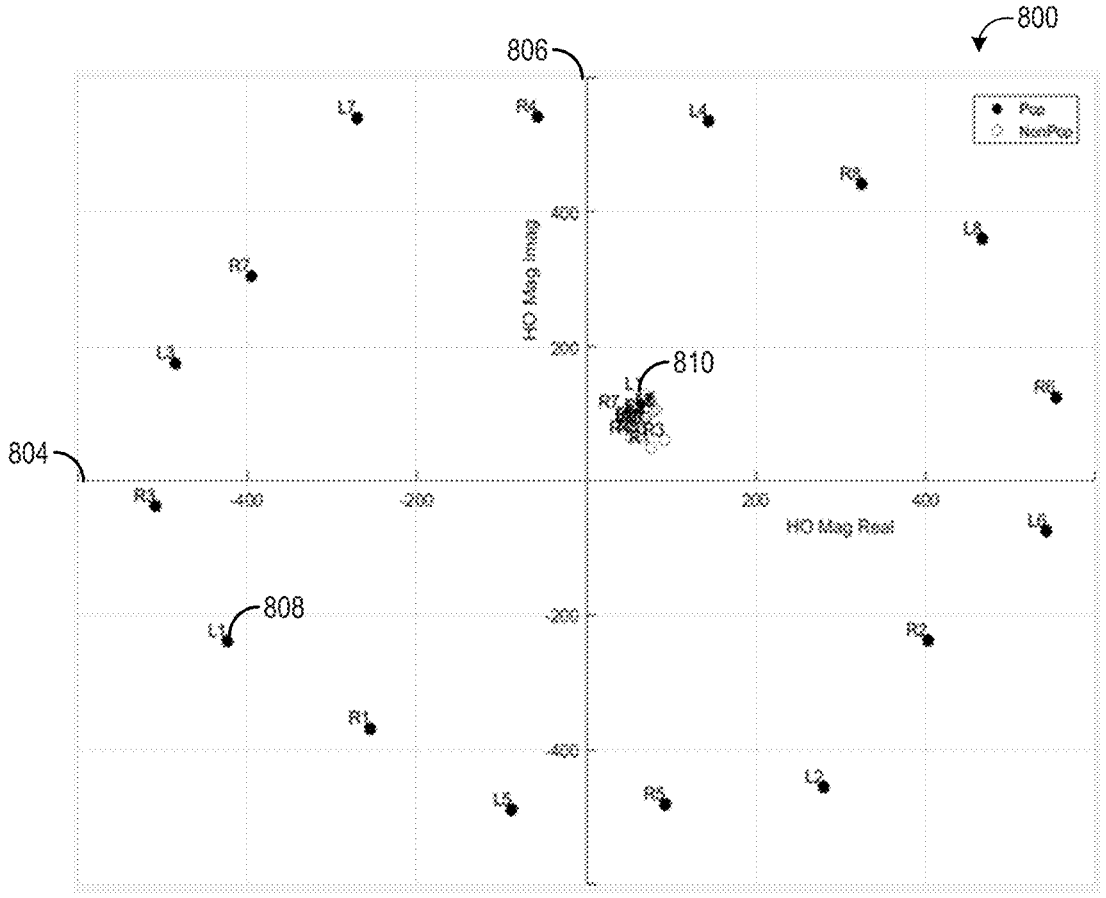
FIG. 8 shows an example plot of half-order frequency components for a plurality of healthy cylinders during a pop test.

Turning now to FIG. 8, it shows a first example graph 800 illustrating data points for a plurality of healthy cylinders in an engine when they are popping or not popping. The real and imaginary components plotted on graph 800 may be an average of an aggregation of data collected in a predefined range (e.g., 15 seconds) for each signal for each cylinder.

A first axis 804 may be an axis quantifying half-order magnitudes of a real component of a signal (e.g., pop or non-pop). A second axis 806 may be an axis quantifying half-order magnitudes of an imaginary component of the signal (e.g., pop or non-pop). A first data point 808 may represent a median half-order magnitude of a real component along axis 804 and a median half-order magnitude of an imaginary component along axis 806 for a pop signal for a first cylinder (which in this example may be the first cylinder on a left bank of the engine, referred to as L1). A second data point 810 may represent a median half-order magnitude of a real component along axis 804 and a median half-order magnitude of an imaginary component along axis 806 for a non-pop signal for the first cylinder. Each other cylinder of the engine is plotted similarly, e.g., real, imaginary pairs obtained during popping and non-popping. When all cylinders in an engine are healthy, a shift in data may be seen from a pop signal data point for a cylinder to a non-pop signal data point for a same cylinder.

Figure 9:
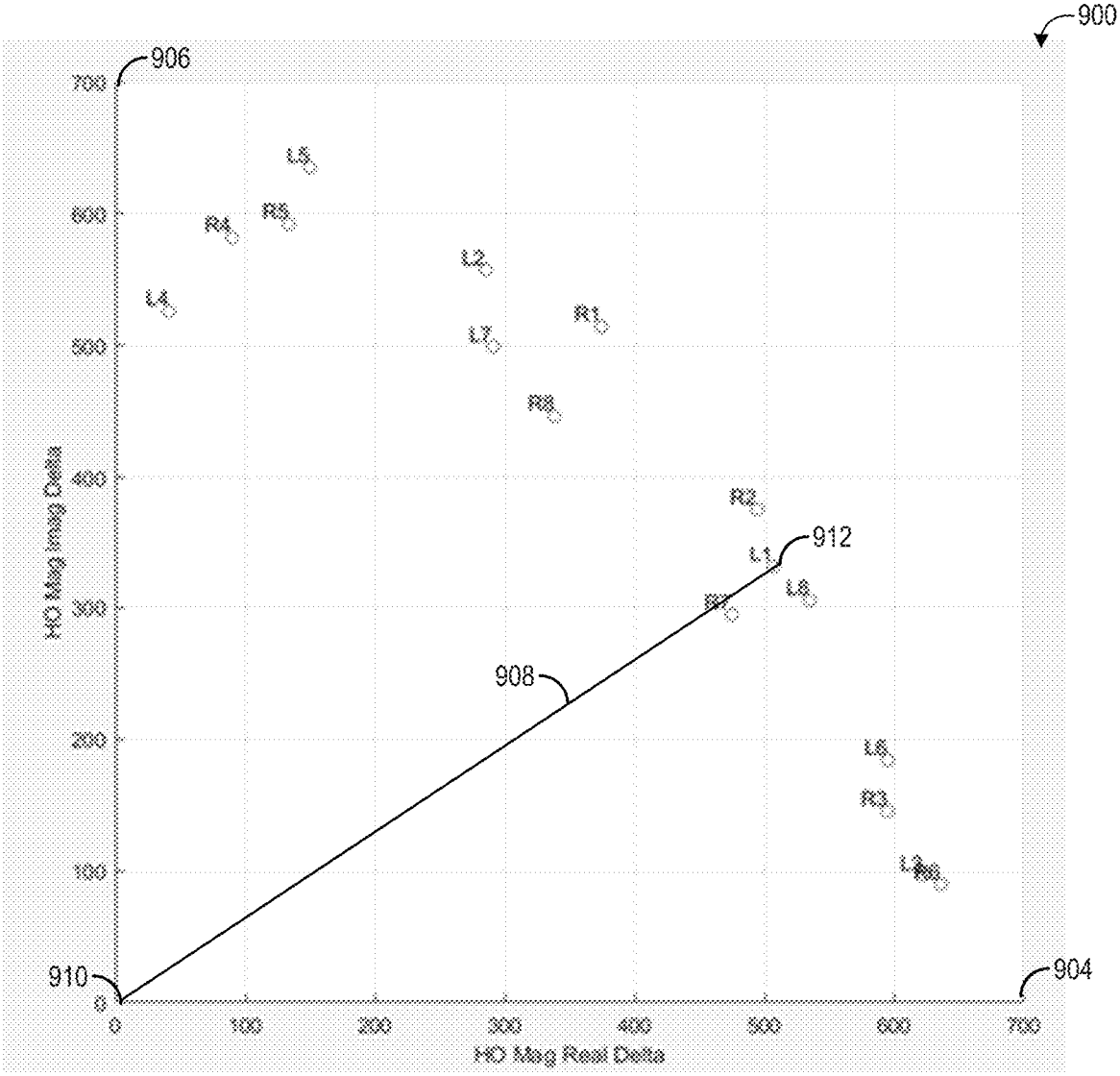
FIG. 9 shows an example plot of change vectors for a plurality of healthy cylinders during a pop test.

Turning now to FIG. 9, it shows a second example graph 900 which may be an absolute value graph, depicting an absolute value of difference between real and imaginary components of pop and non-pop signals for each cylinder. In one example, graph 900 may represent an absolute value of difference between real and imaginary components of pop and non-pop signals for each cylinder in graph 800 of FIG. 8.

A first axis 904 may be an axis quantifying an absolute value of difference between half-order magnitudes of real components of pop and non-pop signals for a cylinder. A second axis 906 may be an axis quantifying an absolute value of difference between half-order magnitudes of imaginary components of pop and non-pop signals for a cylinder.

A distance 908 from an origin 910 of graph 900 to a first data point 912 may be considered a change vector for the first cylinder L1 (corresponding to first data point 912). Each data point in graph 900 may have a corresponding distance from origin 910 such that each cylinder associated with each data point in graph 900 may have a respective change vector. The magnitude of the change vector for each cylinder may be used as criteria for measuring a health of each cylinder. In one example, a length of a change vector represented by a distance in graph 902 may indicate an unhealthy cylinder if the length is less than a threshold value (e.g., closer to 0). Further, the direction of the change vector may be determined and used to validate the test results or as an alternative mechanism for evaluating cylinder health.

Figure 10:
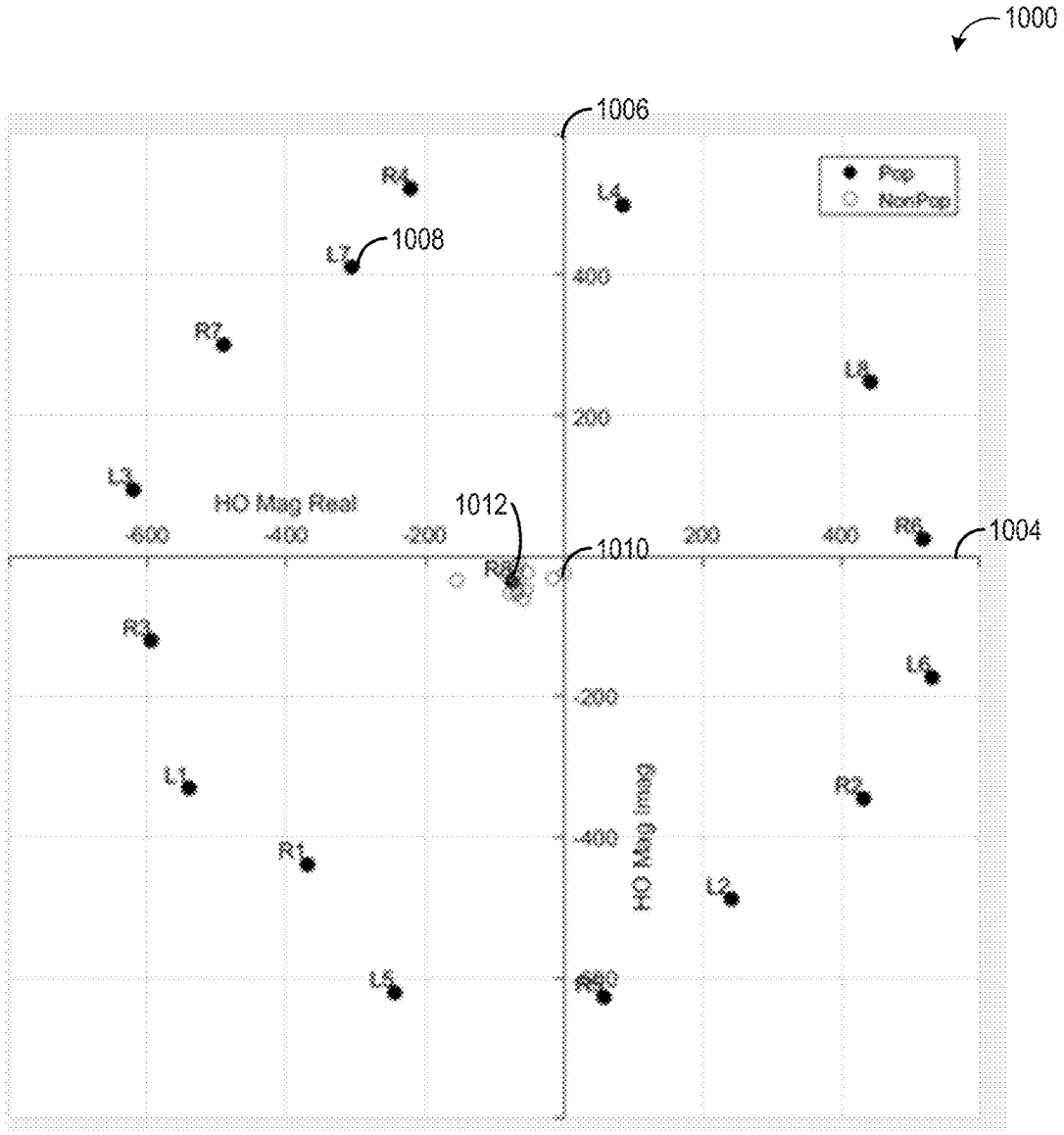
FIG. 10 shows an example plot of half-order frequency components for a plurality of cylinders including an unhealthy cylinder during a pop test.

Turning now to FIG. 10, it shows a third example graph 1000 illustrating data points for a plurality of healthy cylinders and one unhealthy (e.g., disconnected) cylinder. Similar to the data shown in FIG. 8, the real and imaginary components plotted on graph 1000 are an average of an aggregation of data collected during popping and non-popping for each cylinder.

A first axis 1004 may be an axis quantifying half-order magnitudes of a real component of a signal, pop or non-pop. A second axis 1006 may be an axis quantifying half-order magnitudes of an imaginary component of a signal, pop or non-pop. A first data point 1008 may represent a median half-order magnitude of a real component along axis 1004 and a median half-order magnitude of an imaginary component along axis 1006 for a pop signal for a first cylinder. A second data point 1010 may represent a median half-order magnitude of a real component along axis 1004 and a median half-order magnitude of an imaginary component along axis 1006 for a non-pop signal for a first cylinder. In one example, first data point 1008 and second data point 1010 may be data points for a healthy cylinder. A third data point 1012 may represent a real and an imaginary component of a pop signal for a disconnected cylinder (cylinder R8). As appreciated by graph 1000, the median half-order magnitudes of real and imaginary components for third data point 1012 may be similar in real and imaginary component values to a plurality of non-pop signal data points, indicating the cylinder may be unhealthy.

Figure 11:
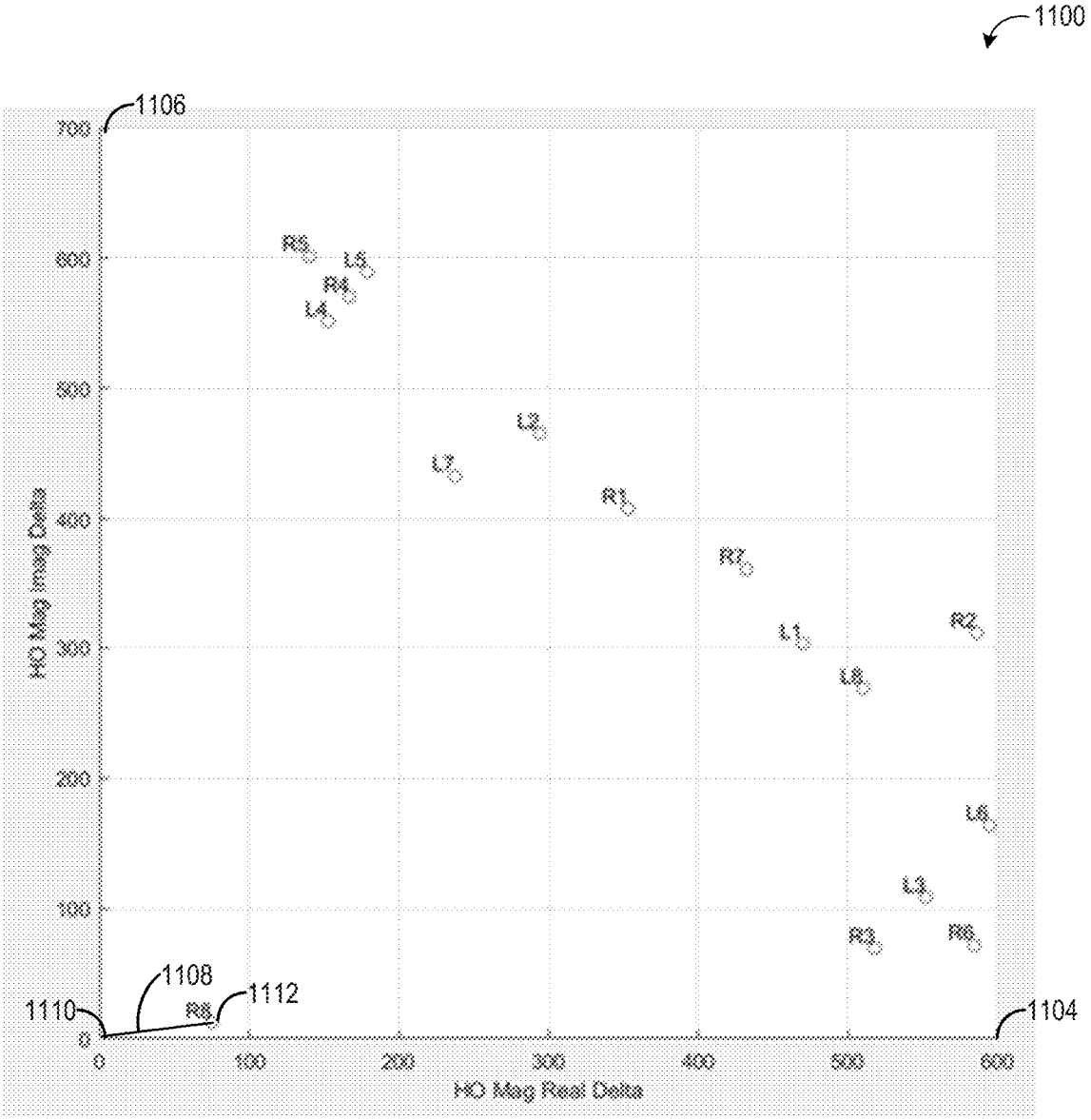
FIG. 11 shows an example plot of change vectors for a plurality of cylinders including an unhealthy cylinder during a pop test.

Turning now to FIG. 11, it shows a fourth example graph 1100 depicting an absolute value of difference between real and imaginary components of pop and non-pop signals for each cylinder in graph 1000 of FIG. 10. A first axis 1104 may be an axis quantifying an absolute value of difference between half-order magnitudes of real components of pop and non-pop signals for a cylinder, similar to first axis 904 of FIG. 9. A second axis 1106 may be an axis quantifying an absolute value of difference between half-order magnitudes of imaginary components of pop and non-pop signals for a cylinder, similar to second axis 906 of FIG. 9.

A distance 1108 from an origin 1110 of graph 1102 to a first data point 1112 may be considered a change vector for the cylinder (R8) corresponding to first data point 1112. Each data point in graph 1100 may have a corresponding distance from origin 1110 such that each cylinder associated with each data point in graph 1100 may have a change vector. The magnitude of the change vector for each cylinder may be used as criteria for measuring a health of each cylinder. In one example, the cylinder associated with first data point 1112 may be considered unhealthy as a result of a significantly shorter magnitude change vector, represented by distance 1108, compared to any other magnitude associated with any other data point in graph 1100.

Figure 12:
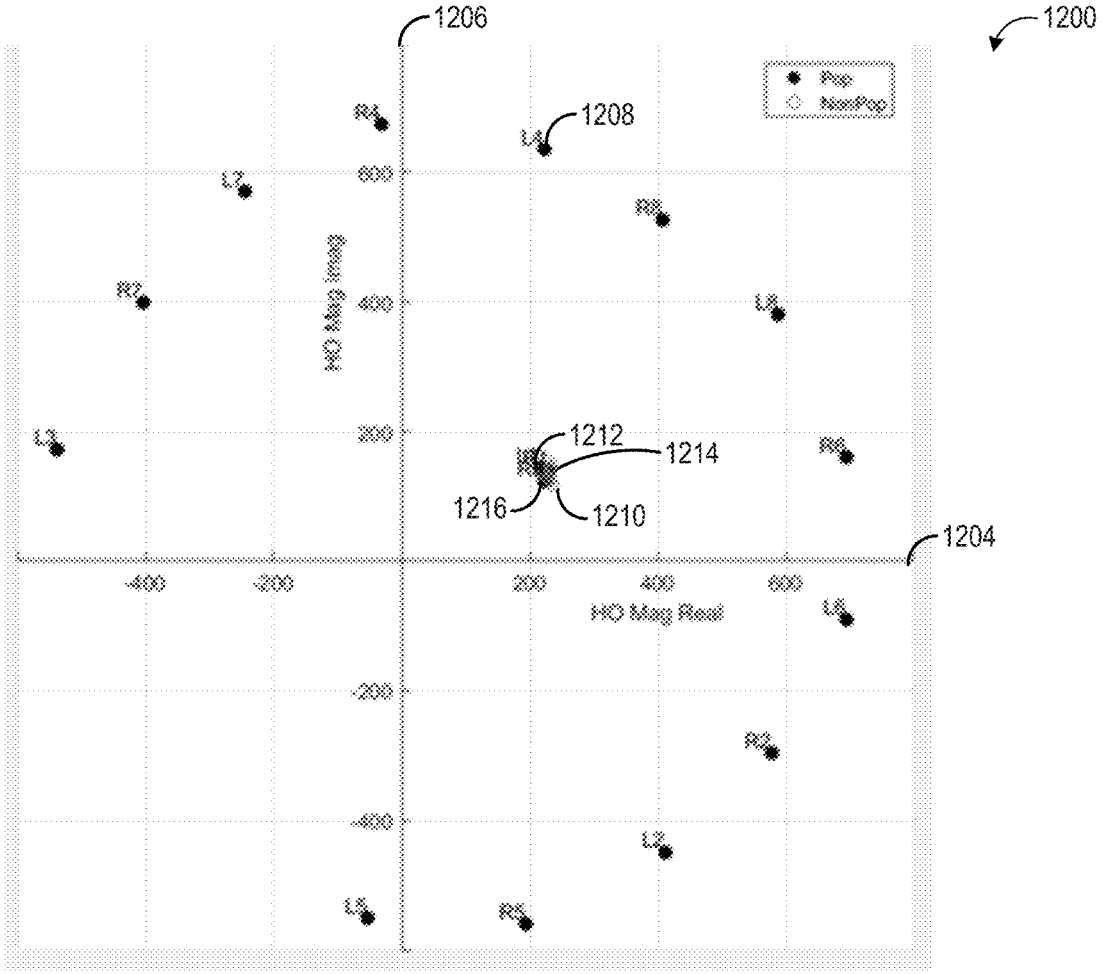
FIG. 12 shows an example plot of half-order frequency components for a plurality of cylinders including two unhealthy cylinders during a pop test.

Turning now to FIG. 12, it shows a fifth graph 1200 with data points for a plurality of healthy cylinders and three disconnected cylinders next to each other in a firing pattern. Similar to the data shown in FIGS. 8 and 10, median real and imaginary pairs for popping and non-popping cylinders are plotted. A first axis 1204 may be an axis quantifying half-order magnitudes of a real component of a signal, pop or non-pop. A second axis 1206 may be an axis quantifying half-order magnitudes of an imaginary component of a signal, pop or non-pop. A first data point 1208 may represent a median half-order magnitude of a real component along axis 1204 and a median half-order magnitude of an imaginary component along axis 1206 for a pop signal for a first cylinder (L4). A second data point 1210 may represent a median half-order magnitude of a real component along axis 1204 and a median half-order magnitude of an imaginary component along axis 1206 for a non-pop signal for the first cylinder. In the example shown, first data point 1208 and second data point 1210 may be data points for a healthy cylinder. A third data point 1212, a fourth data point 1214, and a fifth data point 1216 may represent real and imaginary components of the pop signals for unhealthy (e.g., disconnected cylinders that are not receiving fuel), such that median half-order magnitudes of real and imaginary components for third data point 1212, fourth data point 1214, and fifth data point 1216 may be similar in real and imaginary component values to a plurality of non-pop signal data points, indicating the cylinders may be unhealthy. As mentioned above, the three unhealthy cylinders (R1, L1, and R3) may be positioned sequentially in a firing order of the engine. When multiple cylinders are unhealthy, and in particular when multiple sequentially-fired cylinders are unhealthy, alternate methods of detecting the unhealthy cylinders based on the output from the crankshaft sensor may be insufficient to detect each unhealthy cylinder. For example, comparing the magnitude of the half order frequency for each cylinder during popping to a predetermined threshold may not be robust enough to detect unhealthy cylinders when multiple cylinders are unhealthy. However, as shown in FIG. 12, even though the magnitudes of the healthy cylinders' change vectors are reduced in this case, there is still enough separation between the healthy and unhealthy cylinders to detect the unhealthy cylinders.

Figure 13:
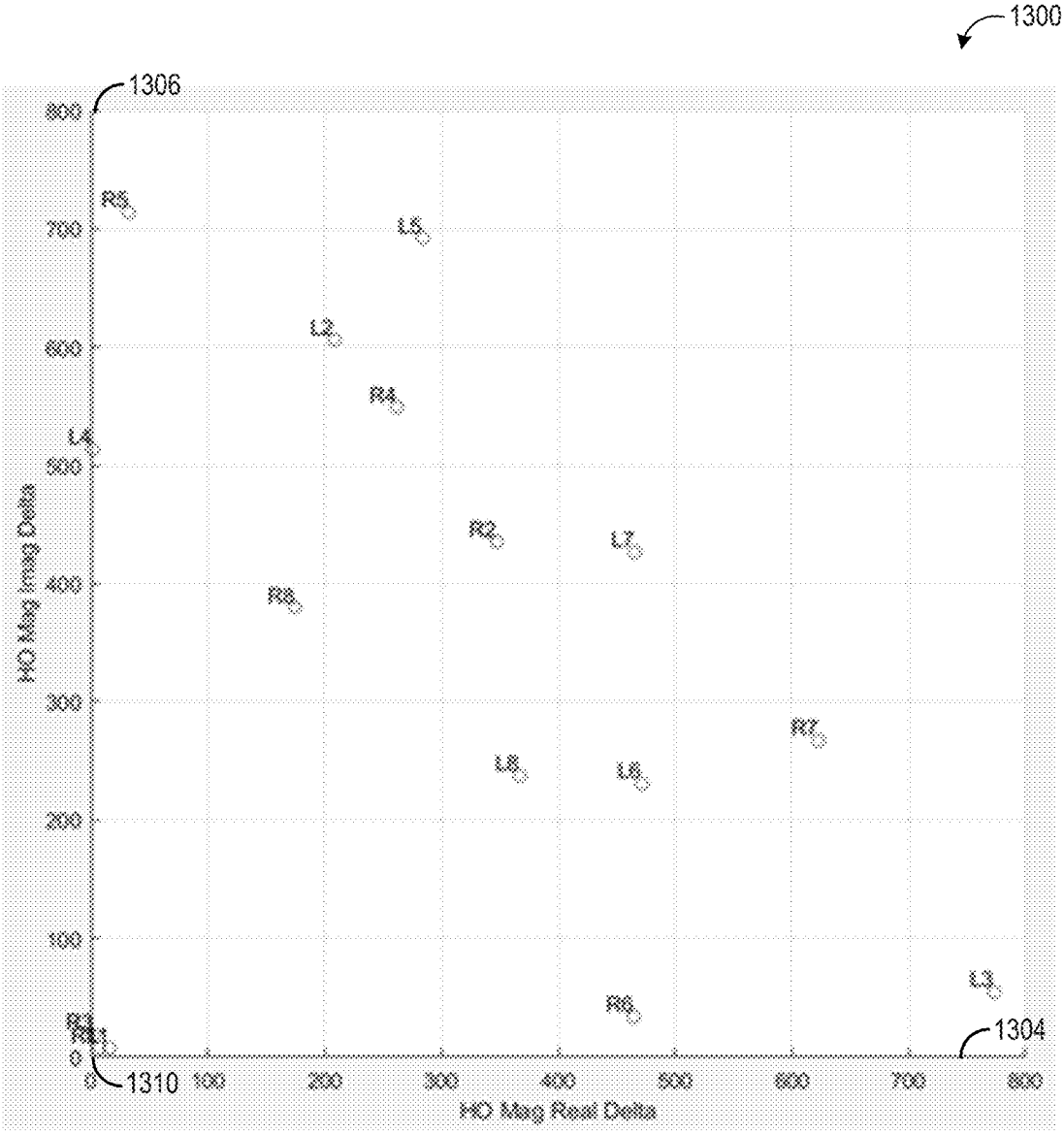
FIG. 13 shows an example plot of change vectors for a plurality of cylinders including two unhealthy cylinders during a pop test.

Turning now to FIG. 13, it shows a sixth example graph 1300 depicting an absolute value of difference between real and imaginary components of pop and non-pop signals for each cylinder in graph 1200 of FIG. 12. A first axis 1304 may be an axis quantifying an absolute value of difference between half-order magnitudes of real components of pop and non-pop signals for a cylinder, similar to first axis 904 of FIG. 9 and first axis 1104 of FIG. 11. A second axis 1306 may be an axis quantifying an absolute value of difference between half-order magnitudes of imaginary components of pop and non-pop signals for a cylinder, similar to second axis 906 of FIG. 9 and second axis 1106 of FIG. 11. As shown, the three unhealthy cylinders (R1, L1, and R3) have coordinates that are relatively close to the origin 1310 and thus each have change vectors with magnitudes that are small enough to indicate that the cylinders are unhealthy.

In one example, all change vectors in graph 1300 may be shorter than change vectors in graphs 1100 or 900 as a result of multiple disconnected cylinders affecting the entire engine, but unhealthy cylinders may still be indicated as a result of the change vectors of those cylinders being comparatively shorter than the vectors associated with other cylinders in graph 1300.

Figure 14:
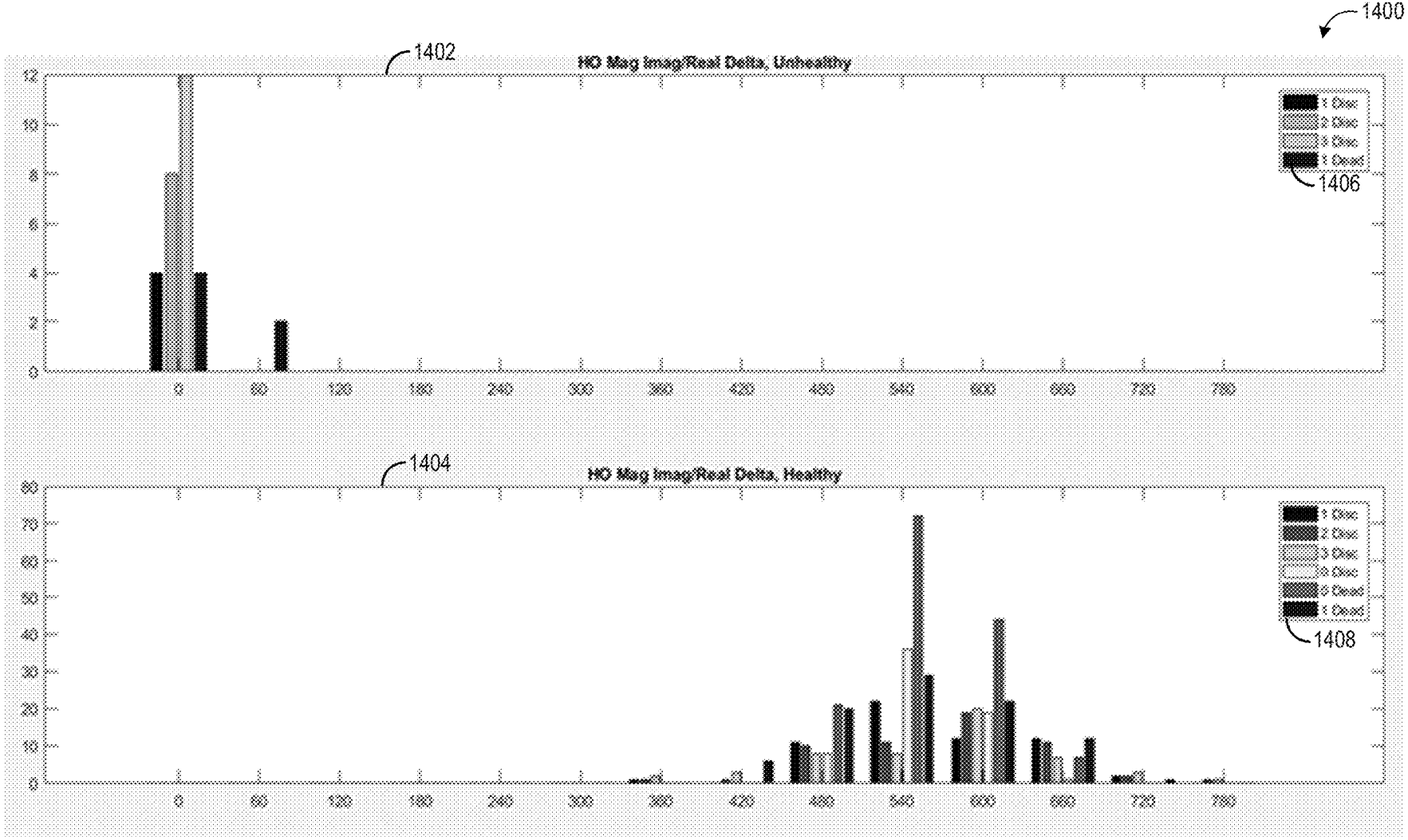
FIG. 14 shows example graphs of change vectors for unhealthy and healthy cylinders.

Turning now to FIG. 14, it shows a set of graphs 1400 including a first graph 1402 and a second graph 1404, representing histograms of change vector lengths for a population of unhealthy cylinders and healthy cylinders, respectively, of an engine exhibiting various different levels/types of unhealthy cylinders.

First legend 1406 indicates the different levels/types of unhealthy cylinders represented in first graph 1402, including a set where one cylinder is disconnected, a set where two cylinders are disconnected, a set where three cylinders are disconnected, and a set where one cylinder is dead. Because first graph 1402 is a histogram of change vector magnitudes for a population of unhealthy cylinders, no data is shown in first graph 1402 from sets where no cylinders are dead or disconnected, as indicated by first legend 1406.

Second legend 1408 indicates the different levels/types of unhealthy and healthy cylinders represented in the second graph 1404, including a set where one cylinder is disconnected (e.g., not receiving fuel due to a fuel injector being disconnected), a set where two cylinders are disconnected, a set where three cylinders are disconnected, a set where no cylinders are disconnected, a set where no cylinders are dead, and a set where one cylinder is dead (e.g., a fuel injector is connected but is not injecting fuel). As indicated by comparing the first graph 1402 and the second graph 1404, a clear separation of distribution may exist between change vector magnitudes for unhealthy cylinders and change vector magnitudes for healthy cylinders. Thus, even in scenarios where multiple cylinders are unhealthy (such as the set where three cylinders are disconnected) and the change vectors for the remaining healthy cylinders span a relatively wide range, sufficient separation is still present between the unhealthy and healthy cylinders.

A technical effect of diagnosing cylinders using a change in magnitude of frequency content of a signal output by a crankshaft speed sensor during a cylinder disturbance relative to when no disturbance is occurring is that one or more than one unhealthy cylinder may be identified. Another technical effect is that analyzing the half-order frequency content with a Goertzel filter may reduce processing demands relative to other methods of diagnosing unhealthy cylinders.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

an engine having a plurality of cylinders coupled to a crankshaft;

a crankshaft speed sensor; and a controller configured to:

receive a first output from the crankshaft speed sensor during nominal engine operation;

receive a second output from the crankshaft speed sensor during engine operation where a fueling disturbance is introduced to a cylinder of the plurality of cylinders;

indicate that the cylinder is unhealthy responsive to a difference between the first output and the second output being less than a threshold difference; and adjust one or more operating parameters of the engine in response to the indication, wherein the fueling disturbance is carried out for a dynamic duration opportunistically based on engine operating conditions, the dynamic duration based on a distribution of samples of the first output, and wherein adjusting one or more engine operating parameters in response to detecting the unhealthy cylinder comprises lowering engine load on remaining, healthy cylinders of the engine.

2. The system of claim 1, wherein the controller is configured to:

process the first output to obtain real and imaginary components of a first half order frequency signal and process the second output to obtain real and imaginary components of a second half order frequency signal; and determine the difference between the first output and the second output based on a difference between the real and imaginary components of the first half order frequency signal and the real and imaginary components of a second half order frequency signal.

3. The system of claim 2, wherein the first output and the second output are sampled and processed at a given update frequency to obtain multiple real and imaginary components of the first half order frequency signal and multiple real and imaginary components of the second half order frequency signal, and wherein the controller is configured to:

identify a first median real component and a first median imaginary component from the first half order frequency signal and identify a second median real component and a second median imaginary component from the second half order frequency signal; and determine the difference between the first output and the second output based on an absolute value of a difference between the first median real component and the first median imaginary component and the second median real component and the second median imaginary component.

4. The system of claim 1, wherein the fueling disturbance includes supplying an increased amount of fuel to the cylinder relative to remaining cylinders of the engine.

5. The system of claim 4, wherein the controller is configured to supply the increased amount of fuel to the cylinder responsive to a user input, and wherein the increased amount of fuel is supplied to the cylinder for a fixed duration.

6. The system of claim 4, wherein the controller is configured to supply the increased amount of fuel to the cylinder automatically when cylinder test conditions are met.

7. The system of claim 1, wherein the controller is further configured to indicate that the cylinder is healthy responsive to the difference between the first output and the second output being greater than the threshold difference.

8. The system of claim 1, wherein the cylinder is a first cylinder and the plurality of cylinders includes a second cylinder, and wherein the controller is configured to:

receive a third output from the crankshaft speed sensor during a subsequent nominal engine operation;

receive a fourth output from the crankshaft speed sensor during engine operation where a fueling disturbance is introduced to the second cylinder; and indicate that the second cylinder is unhealthy responsive to a difference between the third output and the fourth output being less than the threshold difference.

9. A method comprising:

detecting an unhealthy cylinder responsive to a first half-order frequency component of a signal output from a crankshaft speed sensor during over-fueling of the unhealthy cylinder being within a threshold of a second half-order frequency component of the signal output from the crankshaft speed sensor during normal fueling of the unhealthy cylinder; and adjusting one or more engine operating parameters in response to detecting the unhealthy cylinder, wherein the first half-order frequency component comprises a first median real, imaginary pair obtained from the signal output by the crankshaft speed sensor during the over-fueling and the second half-order frequency component comprises a second median real, imaginary pair obtained from the signal output by the crankshaft speed sensor during the normal fueling.

10. The method of claim 9, wherein over-fueling of the unhealthy cylinder comprises providing an increased amount of fuel to the unhealthy cylinder relative to a respective amount of fuel provided to remaining cylinders of the engine, and normal fueling of the unhealthy cylinder comprises providing a same amount of fuel to the unhealthy cylinder as a respective amount of fuel provided to the remaining cylinders, and wherein engine speed is maintained constant during the over-fueling of the unhealthy cylinder and the normal fueling of the unhealthy cylinder.

11. The method of claim 9, wherein the over-fueling is carried out for a fixed duration in response to a user request during engine idle conditions.

12. A method comprising:

detecting an unhealthy cylinder responsive to a first half-order frequency component of a signal output from a crankshaft speed sensor during over-fueling of the unhealthy cylinder being within a threshold of a second half-order frequency component of the signal output from the crankshaft speed sensor during normal fueling of the unhealthy cylinder; and adjusting one or more engine operating parameters in response to detecting the unhealthy cylinder, wherein the over-fueling is carried out for a dynamic duration opportunistically based on engine operating conditions, the dynamic duration based on a distribution of samples of the first half-order frequency component, and wherein adjusting one or more engine operating parameters in response to detecting the unhealthy cylinder comprises lowering engine load on remaining, healthy cylinders of the engine.

13. A method comprising:

detecting an unhealthy cylinder responsive to a first half-order frequency component of a signal output from a crankshaft speed sensor during over-fueling of the unhealthy cylinder being within a threshold of a second half-order frequency component of the signal output from the crankshaft speed sensor during normal fueling of the unhealthy cylinder;

detecting a healthy cylinder responsive to a third half-order frequency component of the signal output from the crankshaft speed sensor during over-fueling of the healthy cylinder being greater than the threshold of a fourth half-order frequency component of the signal output from the crankshaft speed sensor during normal fueling of the healthy cylinder; and adjusting one or more engine operating parameters in response to detecting the unhealthy cylinder.

* * * * *